US006612780B2

(12) United States Patent
Dahowski et al.

(10) Patent No.: US 6,612,780 B2
(45) Date of Patent: Sep. 2, 2003

(54) MODULAR TRENCH DRAIN SYSTEM

(75) Inventors: Donald E. Dahowski, York, PA (US); James G. Wilson, Lancaster, PA (US); Allen L. Kinner, Lititz, PA (US); Christopher B. Presler, Lancaster, PA (US); Matthew B. Schlager, Lancaster, PA (US)

(73) Assignee: Quaker Plastic Corporation, Mountville, PA (US)

( * ) Notice: Subject to any disclaimer, the term of this patent is extended or adjusted under 35 U.S.C. 154(b) by 0 days.

(21) Appl. No.: 09/987,606

(22) Filed: Nov. 15, 2001

(65) Prior Publication Data

US 2002/0057945 A1 May 16, 2002

Related U.S. Application Data

(60) Provisional application No. 60/248,212, filed on Nov. 15, 2000.

(51) Int. Cl.[7] ..... E03B 5/00; E01C 11/22

(52) U.S. Cl. ..... 405/118; 210/164; 210/170; 404/2

(58) Field of Search ..... 210/163–166, 210/170; 404/2–5; 52/11–16; 405/118–123

(56) References Cited

U.S. PATENT DOCUMENTS

| | | | | | |
|---|---|---|---|---|---|
| 3,876,322 | A | | 4/1975 | Deason | 404/2 |
| 4,490,067 | A | | 12/1984 | Dahowski | 404/4 |
| 4,815,888 | A | * | 3/1989 | Stegmeier | 404/4 |
| 4,910,811 | A | * | 3/1990 | Izzi, Sr. | 4/292 |
| 5,024,550 | A | | 6/1991 | Mainville | 404/4 |
| 5,026,202 | A | | 6/1991 | Thomann | 404/4 |
| 5,061,116 | A | | 10/1991 | Monks | 405/43 |
| 5,066,165 | A | | 11/1991 | Wofford et al. | 405/119 |
| 5,181,793 | A | * | 1/1993 | Dekel | 404/4 |
| 5,213,438 | A | | 5/1993 | Bärenwald | 404/2 |
| 5,226,748 | A | | 7/1993 | Bärenwald et al. | 405/121 |
| 5,281,052 | A | | 1/1994 | Beamer | 405/119 |
| 5,340,234 | A | | 8/1994 | Rossi et al. | 405/48 |
| 5,501,547 | A | * | 3/1996 | Mantelli | 405/121 |
| 5,529,436 | A | | 6/1996 | Meyers | 405/119 |
| 5,628,152 | A | * | 5/1997 | Bowman | 52/20 |
| 6,027,283 | A | * | 2/2000 | Schweinberg et al. | 405/42 |

* cited by examiner

*Primary Examiner*—Thomas B Will
*Assistant Examiner*—Tara L. Mayo
(74) *Attorney, Agent, or Firm*—Nixon Peabody LLP; Daniel S. Song

(57) ABSTRACT

A modular trench drainage system for placement in a trench of a natural surface or pavement. The system includes a base conduit, a grate cover pivotably secured to the base conduit for covering the base member, a coupling mechanism for pivotably securing the grate cover to the base conduit, an alignment mechanism for aligning the grate cover with respect to the base conduit when the grate cover is placed in a closed position over the base conduit, and a locking mechanism for locking the grate cover to the base conduit.

31 Claims, 16 Drawing Sheets

MODULAR TRENCH DRAIN SYSTEM

This application claims priority to U.S. Provisional Application No. 60/248,212, filed Nov. 15, 2000.

BACKGROUND OF THE INVENTION

1. Field of the Invention

The present invention relates generally to a modular trench drainage system including a base member and a removable grate cover, and especially, such a system that reduces the installation time of the drainage system and accommodates expansion and/or contraction of a surrounding natural surface or pavement area.

2. Description of the Related Art

Conventional trench drains are typically recessed into a natural surface or pavement area composed of a material such as concrete and the like for catching fluid runoff and preventing entry of undesirable debris such as leaves and branches into the drain. These drains comprise generally a base frame member and a grate cover which is positioned on and received by the base member in order to cover an exposed opening at the upper surface of the base frame member. The base frame member includes a lower wall and a pair of sidewalls extending from the lower wall to define a fluid conduit. Typically, upper end surfaces of each sidewall are mitered in order to provide a support surface for the grate cover. The grate cover includes a lower surface which rests on the base frame member conduit and an upper surface that serves as a support surface for vehicular and/or pedestrian traffic. The upper surface of the grate cover is provided with a plurality of openings along its length to permit the entry of fluid runoff into the base frame member.

A disadvantage of conventional trench drain systems is the potential safety hazard resulting from the lack of a connection, removable or otherwise, between the grate cover and the base frame member. Because the grate cover is unattached to the base frame member, unintentional, unauthorized or accidental removal of the top cover is likely, and thus, could result in injury to a pedestrian or damage to a vehicle.

Another disadvantage of conventional trench drain systems is the difficulty and time involved with the installation and/or removal the grate cover from the base frame member. This is due to the use of complicated attachments schemes for establishing a secure connection between the grate cover and the base frame member.

Yet another disadvantage of conventional trench drain systems is the inability of removing the grate cover from the base frame member in order to perform maintenance on the system. For example, some trench drain systems are characterized in a permanent, unitary attachment between the grate cover and base frame member, thereby preventing the removal of the grate cover. Because quick and easy access to the interior of the base frame member cannot be accomplished by merely removing the grate cover therefrom, the entire system must be removed in order to perform routine maintenance such as removing debris and sediment from the interior of the base frame member.

Still another disadvantage associated with conventional trench drain systems is the instability of the connection between the grate cover and base frame member when the natural surface or pavement area in which the trench drain is inserted expands and/or contracts. For example, during warmer months, the natural surface or pavement area surrounding the sidewalls of the base frame member become heated, thereby expanding and exerting an inward force or pressure on the sidewalls. This force causes the sidewalls to deflect laterally inwardly, and thus, results in their original shape becoming distorted.

The distortion of the sidewalls adversely effects the connection between the grate cover and the base frame member in at least two ways. First, the distortion of the sidewalls may cause a loss in connection between the grate cover and the base frame member. Such a loss in connection diminishes the ability of the trench drain to prevent unwanted debris from entering therein and may also cause potential hazards to both pedestrians and/or vehicular traffic. Secondly, the distortion of the sidewalls may place the grate cover out of alignment with the base frame member. In other words, the distortion of the sidewalls may cause bulging of the grate cover, thereby resulting in difficulty in or even preventing the re-establishment of the connection between the grate cover and the base frame member even if an intentional, unintentional, unauthorized or accidental removal of the grate cover from the base frame member has occurred. This becomes economically disadvantageous since the trench drain system must be removed and replaced with a new trench drain system.

It is known, for example, as disclosed in U.S. Pat. No. 4,490,067, to provide a modular drain system that functions as an expansion joint to accommodate expansions and contractions in concrete slabs into which the drain is embedded. This system, however, includes an integrated design characterized by an upper portion which functions as a grate cover and which is permanently attached to a lower portion which function as a base frame member for accommodating entry and removal of a fluid. Accordingly, performing routine maintenance such as cleaning of the system is difficult since the entire drain system must be replaced.

SUMMARY OF THE INVENTION

Accordingly, it is an object of the present invention to overcome the foregoing disadvantages in providing a modular trench drain system that reduces the time involved for installation and removal of the system.

It is another object of the present invention to provide such a system having a base conduit and a detachable grate that allows the facilitation of routine maintenance.

It is a further object of the present invention to provide such a system having a pivotal connection between the base conduit and the grate cover that facilitates the removal of the grate cover from the base conduit in a simple, yet expedient manner.

It is a still another object of the present invention to provide such a system which is capable of withstanding distortion of the base conduit without losing the connection between the grate cover and the base conduit.

It is yet a further object of the present invention to provide such a system having a robust connection between the grate cover and the base conduit even in cases which the base conduit becomes distorted due to the expansion and/or contraction of the surrounding natural surface or pavement area.

It is still a further object of the present invention to provide such a system having a structural interconnection between the grate member and the base conduit that facilitates reconnection of the grate cover to the base conduit even in cases in which the base conduit becomes distorted due to the expansion and/or contraction of the surrounding natural surface or pavement area.

It is yet another object of the present invention to provide such a system that permits realignment between the grate cover and the base conduit even in cases in which the base conduit becomes distorted due to the expansion and/or contraction of the surrounding natural surface or pavement area.

Yet and still another object of the present invention is to provide such a system having a grate cover that is mechanically fastened to the base conduit to prevent unintentional, accidental or unauthorized open drain conditions.

These, as well as other objects, are achieved in accordance with an exemplary embodiment of the present invention in which a modular trench drain system is provided for placement into a natural surface or pavement area such as concrete or the like. The system includes a base conduit and a grate cover pivotably connected to the base conduit for movement between an open position exposing an upper surface of the base conduit and a closed position covering the exposed upper surface of the base conduit while permitting fluid communication between the exterior of the cover and the base conduit.

The base conduit includes a support surface for supporting and anchoring the base conduit in a trench formed in the natural surface or pavement area, an interior lower wall, and a pair of opposing sidewalls extending upwardly from the lower wall to define a channel that permits the collection and flow of a liquid such as water and the like. The support surface includes a pair of flange members which outwardly extend perpendicularly with respect to the sidewalls to allow the base conduit to be secured to the natural surface or pavement area via nails, bolts or the like, and thereby prevents movement of the base conduit relative to the natural surface or pavement area.

The grate cover includes a substantially rectangular body including a lower surface that faces into the channel of the base conduit and an upper surface that is coplanar with the contiguous surface of the natural surface or pavement area. The grate cover body is provided with a plurality of spaced openings that extend from the upper surface to the lower surface to permit communication between the exterior and the channel for admitting fluids such as water or the like into the channel.

The system further includes a coupling mechanism for pivotably securing or connecting the grate cover to the conduit base when the grate cover is in the closed position. The coupling mechanism includes a first coupling member formed at the upper end of the sidewall and a second coupling member formed on the lower surface of the grate cover body. The second coupling member is adapted to form a pivotal locking engagement with the first coupling member when the grate cover is in the closed position. The first coupling member includes an elongated flange that projects substantially perpendicularly from the sidewall and into the channel. The second coupling member includes an elongated shaft and a shoulder that projects substantially perpendicularly from the shaft. The shoulder is spaced from the lower surface of the grate cover to define a groove or gap into which a distal end of the first coupling member is pivotably received when the grate cover is in the closed position. In this way, the connection between the first coupling member and the second coupling member function together as a hinge-type joint.

Located in a transverse direction opposite to the coupling mechanism is an alignment mechanism for aligning the grate cover with respect to the base conduit when placing the grate cover in the closed position. The alignment mechanism includes an alignment bar formed at the lower surface of the grate cover at a position opposite to the second coupling member and an alignment bar formed at the upper end of the sidewall for engaging the alignment bar when the grate cover is in the closed position.

In a second embodiment, the modular trench drain system includes a coupling mechanism having an upper coupling member and a lower coupling member each formed at the upper end of one sidewall. A second coupling includes an extension arm which is offset downwardly from the upper surface of the grate cover body and a shoulder which projects substantially perpendicularly from the extension arm. The upper coupling member is spaced from the lower coupling member to define a groove or gap into which the second coupling member is pivotably received when the grate cover is in the closed position. The system of the second embodiment includes an alignment mechanism. An alignment mechanism including an alignment bar is provided for aligning the grate cover with respect to the base conduit when placing the grate cover in the closed position. The alignment bar is provided with a contact surface adapted to contact an upper flange member when the grate cover is in the closed position is provided.

In a third embodiment, the system includes symmetrical coupling mechanisms for pivotably securing the grate cover to the base conduit when the grate cover is in the closed position. The coupling mechanisms include a pair of first coupling members formed at the upper end of the sidewalls, respectively, and a pair of second coupling members formed on the lower surface of the grate cover body and adapted to pivotably engage the first coupling members, respectively, when the grate cover is in the closed position. The first coupling members each include an elongated flange that projects substantially perpendicularly from a respective sidewall while the second coupling members each include an elongated shaft having a projection which is spaced from the lower surface to define a groove or gap into which the first coupling members are pivotably received, respectively, when the grate cover is in the closed position. In this way, the connection between the first coupling members and the second coupling members function together as hinge-type joint.

A fourth embodiment of the invention includes a drain system that provides additional protection against expansion and/or contraction of a surrounding natural surface or pavement area that may adversely effect the connection between the grate cover and the base conduit. The modular trench drain system includes a base conduit having a lower wall and a pair of opposing sidewalls with vertical extensions which protect the outer side surfaces of the grate cover from the effects of expansion and/or contraction of a surrounding natural surface or pavement. Accordingly, the vertical extensions absorb the forces associated with the expansion and/or contraction of the surrounding natural surface or pavement area.

Each embodiment may be provided with additional coupling mechanisms for mechanically locking or securing the grate cover to the base conduit. These coupling mechanisms include a plurality of fasteners such as screws, bolts or the like which are rotateably secured into pre-drilled or pre-threaded bores that extend throughout the base conduit and the grate cover. The combination of the coupling mechanisms and the alignment mechanism function to prevent the unintentional, unauthorized or accidental vertical and longitudinal displacement of the grate cover with respect to the base conduit once the grate cover is in the closed position. They also function to allow easy access to the interior of the base conduit to perform maintenance on the drain system.

Moreover, various fittings, such as universal Tee or universal cross connectors, end adapters, end plugs and the like may be provided to facilitate on site installation of the trench drain system. In order to interconnect a plurality of axially-aligned modular trench drain assemblies, a connector member is provided to establish an elongated channel of indefinite length and devoid of any structural breaks or seals. The connector member may include a gasket member that provides a mechanical seal between assemblies.

The present invention will now be further described by reference to the following drawings.

DETAILED DESCRIPTION OF THE INVENTION

Figure 1:
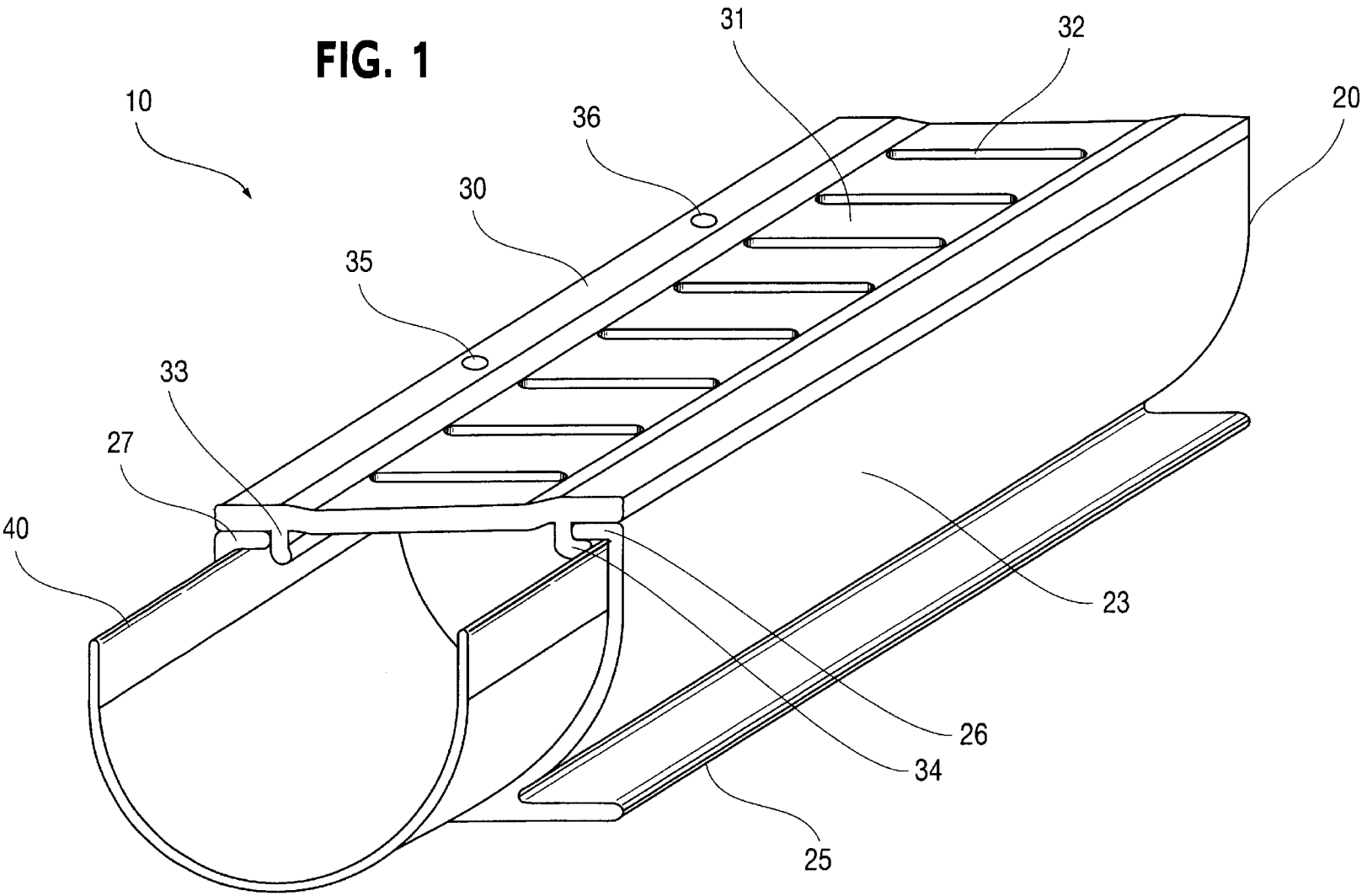
FIG. 1 is a perspective view of a modular trench drain system in accordance with the present invention.
Figure 2:
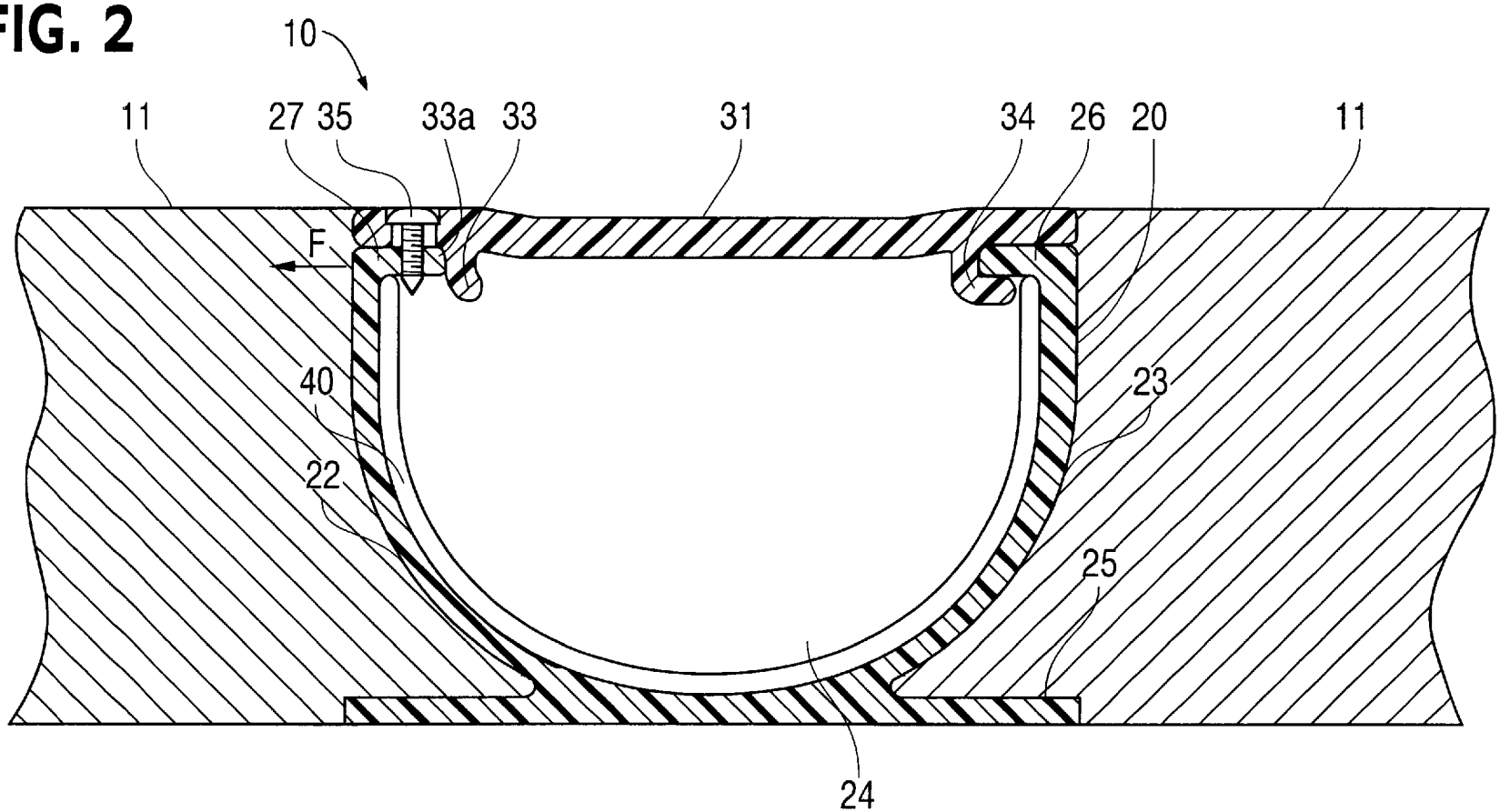
FIG. 2 is a cross-sectional frontal view of the modular trench drain system of FIG. 1 in accordance with the present invention.
Figure 3:
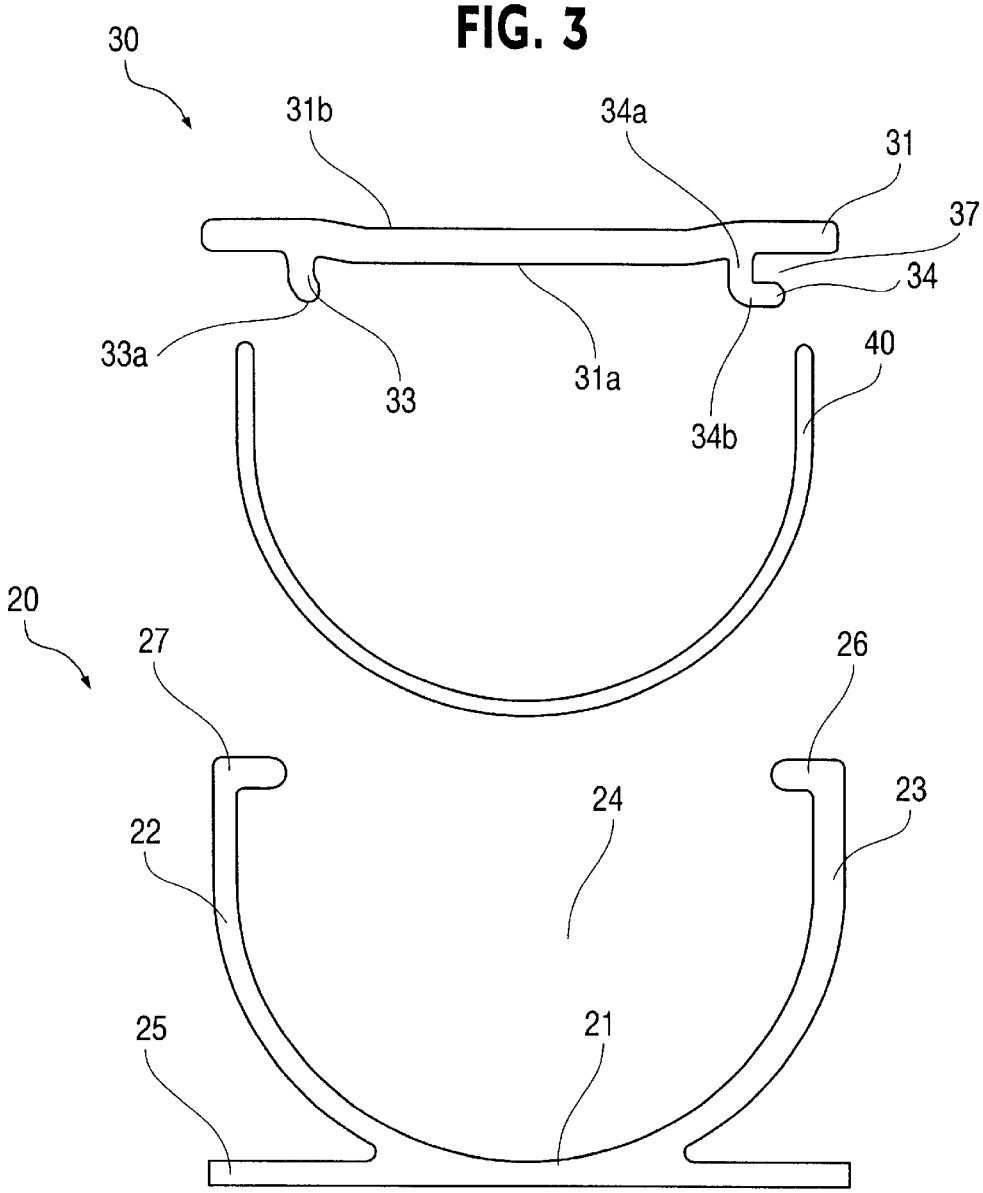
FIG. 3 is a cross-sectional exploded view of the modular trench drain system of FIG. 1.

Referring now to the drawings and, more particularly, to FIGS. 1–3, which illustrate in an exemplary embodiment in accordance with the present invention, a modular trench drain system 10 for placement in a trench of a natural or pavement area 11 such as concrete or the like. The modular trench drain system 10 includes a base conduit 20 and a grate cover 30 pivotably connected to the base conduit 20 for movement between an open position exposing an upper surface of the base conduit 20 and a closed position covering the exposed upper surface of the base conduit 20 while permitting fluid communication between the exterior of the cover 30 (i.e., the outside environment) and the base conduit 20. In order to interconnect a plurality of axially-aligned modular trench drain assemblies 10, a connector member 40 is provided to establish an elongated channel of indefinite length and devoid of any structural breaks or seals. Preferably, the connector member 40 has a shape that matches the contour of the inner surface of the base conduit 20 and is bonded or connected to the inner surface of a respective base conduit 20 using any suitable industrial adhesive or mechanical bonding technique. Of course, both the base conduit 20 and the connector member 40 may be of any shape that permits the accumulation and removal of a fluid.

As best depicted in FIGS. 2 and 3, the base conduit 20 includes a support surface 25 for supporting and anchoring the base conduit 20 in the trench formed in the natural surface or pavement area 11, an interior lower wall 21, and pair of opposing sidewalls 22, 23 extending upwardly from the lower wall 21 to define a channel 24 that permits the collection and flow of a liquid such as water and the like. The support surface 25 includes a pair of flange members which outwardly extend substantially perpendicularly with respect to the sidewalls 22, 23 to allow the base conduit to be secured to the natural surface or pavement area via nails, bolts or the like.

The grate cover 30 includes a substantially rectangular body 31 including a lower surface 31*a* that faces into the channel 24 and an upper surface 31*b* that is coplanar with the contiguous surface of the natural surface or pavement area 11. The grate cover body 31 is provided with a plurality of spaced openings 32 that extend from the upper surface 31*b* to the lower surface 31*a* to permit fluid communication between the exterior of the system 10 and the channel 24. It will be appreciated by those skilled in the art that the openings 32 may comprise various geometric configurations, such as single slots, double slots, angled slots or any geometric pattern of round or shaped holes that allow fluid entry into the base conduit 20.

The modular trench drain system 10 further includes a coupling mechanism for securing or connecting the grate cover 30 to the conduit base 20 when the grate cover 30 is in the closed position. The coupling mechanism includes a first coupling member 26 formed at the upper end of the sidewall 23. The first coupling member 26 comprises an elongated flange that projects substantially perpendicularly from the sidewall 23 and into the channel 24. Preferably, the first coupling member 26 has a length that extends longitudinally throughout the length of the base conduit 20.

A second coupling member 34 formed on the lower surface 31*a* of the grate cover body 31 is provided to pivotably engage the first coupling member 26 when the grate cover 30 is in the closed position. As best shown in FIG. 3, the second coupling member 34 comprises an elongated shaft 34*a* and a shoulder 34*b* that projects substantially perpendicularly from the shaft 34*a*. The second coupling member 34 has an axial length that extends longitudinally throughout the length of the grate cover 30. The shoulder 34*b* is spaced from the lower surface 31*a* of the grate cover 30, this space defining a groove or gap 37 into which a distal end of the first coupling member 26 is pivotably received when the grate cover 30 is in the closed position. In this way, the connection between the first coupling member 26 and the second coupling member 34 function together as a hinge-type joint.

Accordingly, the second coupling member 34 is adapted to pivot about the distal end of the first coupling member 26 during the installation and/or removal of the grate cover 30 from the base conduit 20. Once engaged, the first and second coupling members 26, 34 function to prevent any unintentional, accidental or unauthorized vertical or upward displacement of the grate cover 30 with respect to base conduit 20 at a point adjacent to the coupling mechanism. The pivotal engagement between the first and second coupling members 26, 34 also facilitates easy installation and removal of the grate cover 30 when routine maintenance on the system 10 is required.

Located transversely in a direction opposite to the coupling mechanism is an alignment mechanism for aligning the grate cover 30 with respect to the base conduit 20 when placing the grate cover 30 in the closed position. The alignment mechanism comprises a flange member 27 and an alignment bar 33. The flange member 27 is formed at the upper end of the sidewall 22 and is adapted to engage the alignment bar 33 when the grate cover 30 is in the closed position. The flange member 27 projects substantially perpendicularly from the sidewall 22 and into the channel 24 and has an axial length which extends longitudinally throughout the length of the base conduit 20.

The alignment bar 33 is formed at the lower surface 31*a* of the grate cover body 31 opposite to the second coupling member 34 and projects into the channel 24 when the grate cover 31 is in the closed position. The alignment bar 33 projects substantially perpendicularly with respect to the lower surface 31*a* of the cover body 31, and preferably, extends longitudinally throughout the length of the grate cover 30. The alignment bar 33 is provided with a contact surface 33*a* that is adapted to contact the flange member 27 when the grate cover 30 is in the closed position.

It will become apparent that, because the first coupling member 26 and the flange member 27 are symmetrical, the grate cover 30 may be rotated 180° so that the contact surface 33*a* of the alignment bar 33 contacts the first coupling member 26. Accordingly, the connection between the alignment bar 33 and the first coupling member 26 may serves as the alignment mechanism. In this regard, the flange member 27 may then be pivotably received into the gap 37 when the grate cover 30 is in the closed position, and thus, may serves as the coupling mechanism.

As best shown in FIG. 2, the system 10 may also include a locking mechanism for locking the grate cover 30 to the base conduit 20. Preferably, the locking mechanism comprises a plurality of fasteners 35, 36 such as screws, bolts or the like that are rotateably secured mechanically into pred-drilled or pre-threaded bores that extend through the flange member 27 and the grate cover 30. The locking mechanism is advantageous since it prevents the grate cover 30 from accidental, unintentional and unauthorized vertical and longitudinal displacement with respect to the base conduit 20 once in the closed position. It will become apparent that additional locking mechanisms may be provided also comprising the fasteners previously described and which are likewise rotateably secured mechanically into pred-drilled or pre-threaded bores that extend through the flange member 26 and the grate cover 30.

In order to secure the grate cover 30 to the base conduit 20, i.e., to place the grate cover 30 in the closed position, the grate cover 30 is manipulated to a position above the base conduit 20 so as to engage the coupling mechanism. In other words, the second coupling member 34 is manipulated downwardly so that the first coupling member 26 is received into the gap 37 created by the coupling member 34 and the grate cover 30. Next, the grate cover 30 is again manipulated downwardly so that the alignment bar 33, specifically the contact surface 33*a*, contacts the distal end or tip of the flange member 27, thereby causing the grate cover 30 to be manipulated to the closed position. When the grate cover 30 is manipulated to the closed position, the contact surface 33*a* applies a support force or pressure to the distal end of the flange 27. When the system 10 is placed in the natural surface or pavement area 11, this force has a magnitude which is at least substantially equal to the force applied to the sidewall 22 by the natural surface or pavement area 11. Thus, an additional point of connection between the grate cover 30 and the base conduit 20 is established. Of course, the grate cover 30 may also be manipulated to the closed position by rotating the grate cover 30 180° so that the flange member 27 enters the gap 37 to form a pivotal engagement with the second coupling member 34.

The locking mechanism for locking the grate cover 30 to the base conduit 20 may be deployed by manually or mechanically screwing the fasteners 35, 36 into the pre-drilled or pre-threaded bores of the flange member 27 and the grate cover 30. As previously mentioned, additional locking mechanisms may be employed by manually or mechanically screwing additional fasteners into pre-drilled or pre-threaded bores of the first coupling member 26 and the grate cover 30. In order to interconnect a plurality of modular trench drain assemblies 10, connector member 40 is merely slid under the first coupling member 26 and flange member 27, which serve to also align the connector member 40 with respect to the base conduit 20.

Thus, the combination of the coupling mechanism, the locking mechanism and the alignment mechanism function to prevent unintentional, unauthorized or accidental vertical and longitudinal displacement of the grate cover 30 with respect to the base conduit 20 once the grate cover 30 is in the closed position. In addition, such a combination facilitates the uncomplicated removal of the grate cover 30 from the base conduit 20 in order to perform routine maintenance on the system 10.

In a situation in which the natural surface or pavement area 11 expands and/or contracts to thereby distort or deform the base conduit 20, i.e., the sidewalls 22, 23, the grate cover 30 may still be manipulated to the closed position even in the event of an intentional, unintentional, unauthorized or accidental removal from the base conduit 20. In such an occurrence, the grate cover body 31 may be manipulated into a position above the base conduit 20 so as to pivotably engage the first coupling member 26 and the second coupling member 34. Next, the side of the grate cover 30, in which the alignment bar 33 extends, is manipulated downwardly so that the contact surface 33*a* applies the support force to the distal end of the flange member 27. The support force includes a substantially lateral force or pressure component, i.e., as indicated by arrow F in FIG. 2, that causes the upper portion of the sidewall 22 to deflect laterally outwardly. The lateral outward deflection of the sidewall 22 increases the overall area at least at an upper area of the conduit 24 to thereby allow the grate cover 30 to rest on the base conduit 20, and thus, establishes a detachable pivotal connection between the grate cover 30 and the base conduit 20. Of course, the grate cover 30 may also be manipulated to the closed position in this situation by rotating the grate cover 30 180° so that the flange member 27 is received into the gap 37. Accordingly, the alignment mechanism is especially effective when the base conduit 20 is deformed due to an inward force or pressure received from the pavement area 11 since it allows the grate cover 30 to be manipulated to the closed position even if an intentional, unintentional, unauthorized or accidental removal of the grate cover 30 has occurred.

Figure 4:
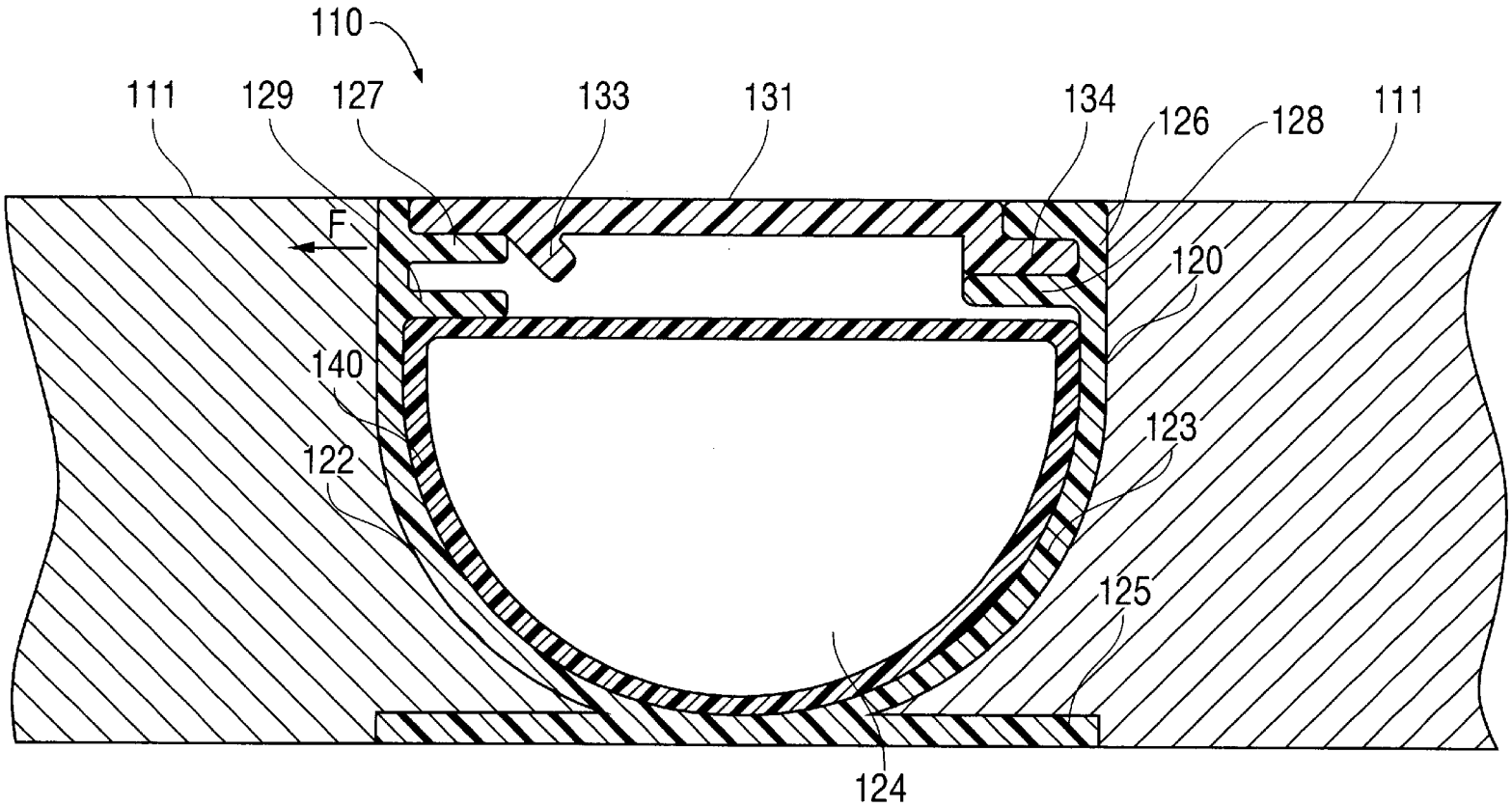
FIG. 4 is a cross-sectional frontal view of the modular trench drain system in accordance with a second embodiment of the present invention.
Figure 5:
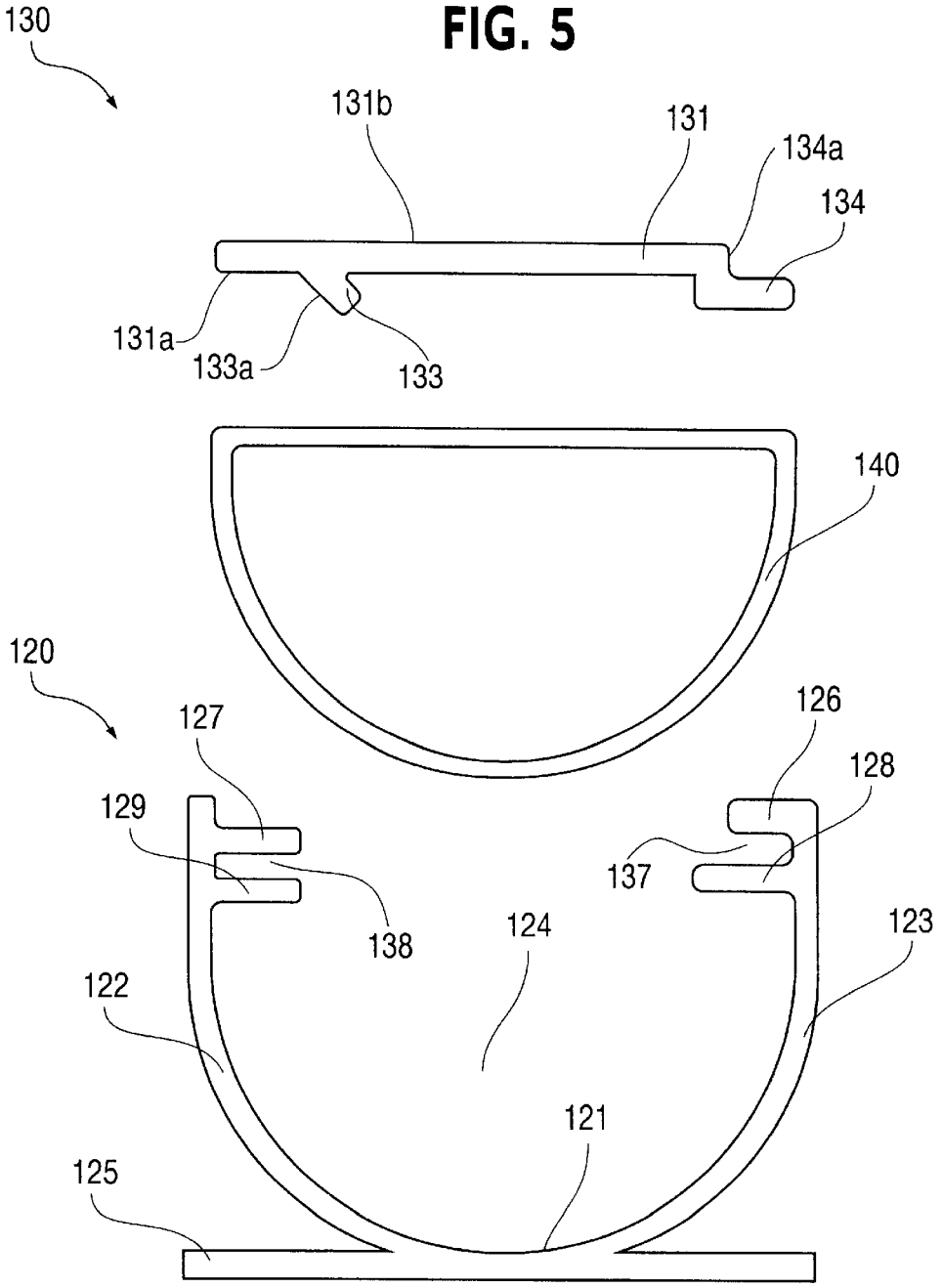
FIG. 5 is a cross-sectional exploded view of the modular trench drain system of FIG. 4.

Referring now to FIGS. 4 and 5, which illustrate in a second embodiment in accordance with the present invention, a modular trench drain system 110 for placement in a trench of a natural surface or pavement area 111 such as concrete or the like. The modular trench drain system 110 includes a base conduit 120 and a grate cover 130 pivotably connected to the base conduit 120 so as to cover an exposed open surface of the base conduit 120. To interconnect a plurality of modular trench drain assemblies 110, a connector member 140 is provided to establish an elongated channel of indefinite length and devoid of any structural breaks or seals. The connector member 140 is preferably of a shape that matches the contour of the inside surface of the base conduit 120 and is bonded or connected to the interior surface of a respective base conduit 120 using any suitable industrial adhesive or mechanical bonding technique. Of course, both the base conduit 120 and the connector member 140 may be of any shape that permits the accumulation and removal of a fluid.

The base conduit 120 includes a support surface 125 for supporting and anchoring the base conduit 120 in the trench formed in the natural surface or pavement area 111, an interior lower wall 121, and pair of opposing sidewalls 122, 123 which extend from the lower wall 121 to define a channel 124 that permits the collection and flow of a liquid such as water and the like. In this regard, the support surface 125 may be secured to the natural surface or pavement 111 via nails, bolts or the like that are driven through the flange members of the support surface 125 and into the ground.

The grate cover 130 includes a substantially rectangular body 131 including a lower surface 131*a* that faces into the channel 124 and an upper surface 131*b* that is coplanar with the contiguous surface of the natural surface or pavement 111. As in the previous embodiment, the grate cover body 131 may be provided with a plurality of spaced openings (not shown) that extend through the upper surface 131*b* to the lower surface 131*a* to permit communication between the exterior of the system 110 (i.e., the outside environment) and the channel 124 for admitting fluids such as water or the like into the channel 124. Accordingly, the grate cover 130 is operable between an open position exposing the channel 124 and a closed position covering the channel 124 while permitting fluid communication between the exterior of the system 110 and the channel 124.

The system 110 further includes a coupling mechanism for pivotably securing the grate cover 130 to the conduit base 120 when the grate cover 130 is in the closed position. The coupling mechanism comprises an upper coupling member 126 and a lower coupling member 128 each formed at the upper end of the sidewall 123 and a coupling member 134 provided on the distal end of the grate cover 131 to form a pivotal engagement with the upper and lower coupling members 126, 128 when the grate cover 130 is in the closed position.

The upper and lower coupling members 126, 128 each comprise an elongated flange that projects substantially perpendicularly from the sidewall 123 into the channel 124, although the lower coupling member 128 extends further into the channel than the upper coupling member 126. Preferably, the upper and lower coupling members 126, 128 each extend longitudinally throughout the length of the base conduit 120 while the coupling member 134 extends longitudinally throughout the length of the grate cover 130. The upper coupling member 126 is spaced from the lower coupling member 126, this space defining a groove or gap 137 into which the coupling member 134 is pivotably received when the grate cover 130 is in the closed position.

As shown in FIG. 5, the coupling member 134 comprises an extension arm which is offset downwardly from the upper surface 131*b* of the grate cover body 131 and a shoulder portion 134*a* which projects substantially perpendicularly from the extension arm. When the grate cover 130 is in the closed position, the distal end of the upper coupling member 126 abuts the shoulder portion 134*a* of the coupling member 134 to establish a pivot point between the upper and lower coupling members 126, 128 and the coupling member 134. Accordingly, the coupling member 134 is adapted to pivot about the distal end of the upper coupling member 126 during installation and/or removal of the grate cover 130. Once engaged, the upper and lower coupling members 126, 128 and the coupling member 134 cooperate to prevent the unintentional, unauthorized or accidental vertical or upward displacement of the grate cover 130 with respect to base conduit 120. The pivotal engagement between the upper and lower coupling members 126, 128 and the coupling member 134 is advantageous since it facilitates the easy installation and removal of the grate cover 130 from the base conduit 120 in order to perform routine maintenance on the system 110.

The system 110 also includes an alignment mechanism for aligning the grate cover 130 with respect to the base conduit 120 when placing the grate cover 130 in the closed position. The alignment mechanism comprises an alignment bar 133 and an upper flange member 127. The alignment bar 133 projects into the channel 124 substantially acutely with respect to the lower surface 131*a* of the cover body 131 and has a length that extends longitudinally throughout the length of the grate cover 130. The alignment bar 133 is provided with a contact surface 133*a* adapted to contact the upper flange member 127 when the grate cover 130 is in the closed position. It will become apparent that the alignment bar 133 may be alternatively positioned so as to extend substantially perpendicularly with respect to the lower surface 131*a* of the cover body 131.

A lower flange member 129 is formed at the upper end of the sidewall 122, the lower flange member 129 being spaced downwardly from upper flange member 127 to form an abutment and alignment surface with the upper surface of the connector 140. The upper flange member 127 is formed at the upper end of the sidewall 122 and has a distal end adapted to engage the alignment bar 133 when the grate cover 130 is in the closed position. The upper flange member 127 projects substantially perpendicularly from the sidewall 122 and into the channel 124 and has an axial length which extends longitudinally throughout the length of the base conduit 120. Like the first embodiment, the system 110 may also be provided with a plurality of fasteners such as screws, bolts or the like to prevent the grate cover 130 from unintentional, unauthorized or accidental vertical and longitudinal displacement with respect to the base conduit 120 once in the closed position. In this regard, the fasteners may be rotateably secured into pred-drilled or pre-threaded bores that extend throughout at least one of the upper flange member 127, the upper coupling member 126 and the grate cover 130 in order to perform this function.

The grate cover 130 may be connected to the base conduit 120 in a similar manner performed in the first embodiment. In other words, the grate cover 130 may be manipulated downwardly to a position above the base conduit 120 so that the coupling member 134 is received into the groove 137 created by the upper and lower coupling members 126, 128.

Next, the grate cover 130 is again manipulated downwardly so that the alignment bar 133, specifically the contact surface 133*a*, contacts the distal end or tip of the upper flange member 127, thereby causing the grate cover 130 to be manipulated to the closed position.

When the grate cover 130 is manipulated to the closed position, the contact surface 133*a* applies a support force to the distal end of the upper flange member 127. When the system 110 is placed in a trench of the natural surface or pavement area 111, this support force has a magnitude which is substantially equal and opposite to the force applied to the sidewall 122 by the pavement area 111. Thus, an additional point of connection between the grate cover 130 and the base conduit 120 is established. In order to interconnect a plurality of modular trench drain assemblies 110, the connector member 140 is merely slid under the lower flange member 129.

In a situation in which the natural surface or pavement area 111 expands and/or contracts to thereby distort or deform the base conduit 120, i.e., the sidewalls 122, 123, the grate cover 130 may still be manipulated to the closed position even in the event of an intentional, unintentional, unauthorized or accidental removal from the base conduit 120. In such an event, the grate cover body 131 is manipulated to a position above the base conduit 120 so as to pivotably engage the upper and lower coupling members 126, 128, and the second coupling member 134. Next, the side of the grate cover 130, in which the alignment bar 133 extends, is manipulated so that the support force is applied from the contact surface 133*a* to the distal end of the upper flange member 127. The support force includes a substantially lateral component, i.e., as indicated by arrow F in FIG. 4, that causes the upper portion of the sidewall 122 to deflect laterally outwardly. The lateral outward deflection of the sidewall 122 increases the overall area of the chamber 124 to allow the grate cover 130 to rest on the base conduit 120, thereby establishing a detachable pivotal connection between the grate cover 130 and the base conduit 120.

Figure 6:
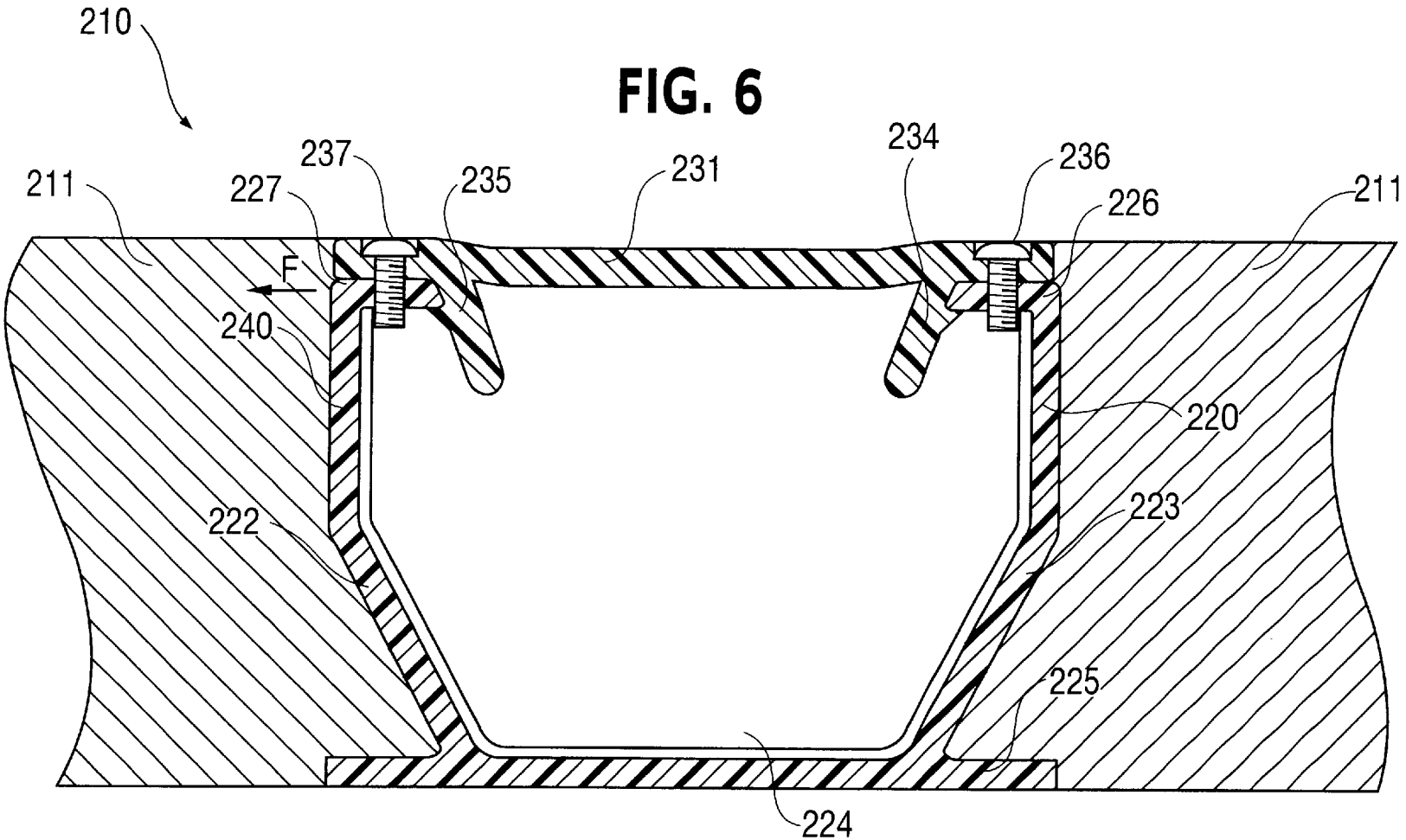
FIG. 6 is a cross-sectional frontal view of the modular trench drain system in accordance with a third embodiment of the present invention.
Figure 7:
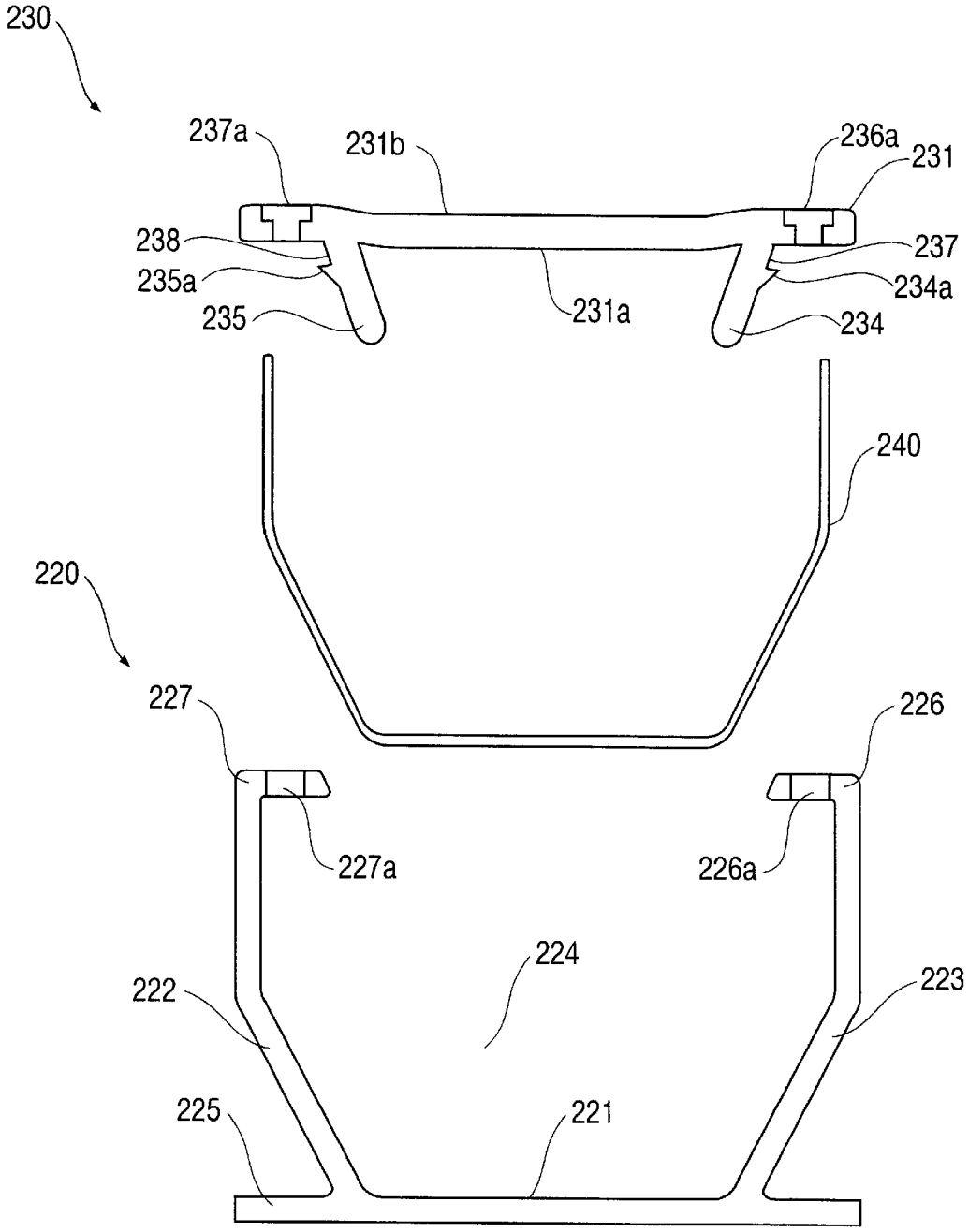
FIG. 7 is a cross-sectional exploded view of the modular trench drain system of FIG. 6.

FIGS. 6 and 7 illustrate a third embodiment in accordance with the present invention in which a modular trench drain system 210 is provided for placement in a trench of a natural surface or pavement area 211 such as concrete or the like. The modular trench drain system 210 includes a substantially hexagonal-shaped base conduit 220 and a grate cover 230 pivotably connected to the base conduit 220 so as to cover an exposed open surface of the base conduit 220. In order to interconnect a plurality of modular trench drain assemblies 210, a connector member 240 is provided to establish an elongated channel of indefinite length and devoid of any structural breaks or seals. The connector member 240 is of a shape that matches the contour of the inside surface of the base conduit 220 and is bonded or connected to the interior surface thereof using any suitable industrial adhesive or mechanical bonding technique. Of course, both the base conduit 220 and the connector member 240 may be of any shape that permits the accumulation and removal of a fluid.

The base conduit 220 includes a support surface 225 for supporting and anchoring the base conduit 220 in the trench formed in the natural surface or pavement 211, an interior lower wall 221, and pair of opposing sidewalls 222, 223 which extend from the lower wall 221 to define a channel 224 that permits the collection and flow of a liquid such as water and the like. As in the previous embodiments, the support surface 225 may be secured to the natural surface or pavement 211 via nails, bolts or the like that are driven through the flange members of the support surface 225 and into the pavement area 211.

The grate cover 230 includes a substantially rectangular body 231 including a lower surface 231*a* that extends into the channel 224 and an upper surface 231*b* that is coplanar with the contiguous surface of the pavement area 211. As provided in the previous embodiments, the grate cover body 231 is preferably provided with a plurality of spaced openings that extend from the upper surface to the lower surface to permit communication between the exterior and the channel 224 for admitting fluids such as water or the like into the channel 224. Accordingly, the grate cover 230 is operable between an open position exposing the channel 224 and a closed position covering the channel 224 while permitting fluid communication between the exterior of the cover 230 (i.e., the outside environment) and the channel 224.

The system 210 is provided with a coupling mechanism for pivotably securing the grate cover 230 to the base conduit 220 when the grate cover 230 is in the closed position. The coupling mechanism comprises a pair of symmetrical first coupling members 226, 227 formed on the upper end of the sidewalls 222, 223, respectively, and a pair of symmetrical second coupling members 234, 235 formed on the lower surface 231*a* of the grate cover body 231. The second coupling members 234, 235 are adapted to pivotably engage the first coupling members 226, 227, respectively, when the grate cover 230 is in the closed position.

The first coupling members 226, 227 each comprise an elongated flange that projects substantially perpendicularly from the sidewalls 222, 223, respectively, and into the channel 224. Preferably, the first coupling members 226, 227 extend longitudinally throughout the length of the base conduit 220. As best shown in FIG. 7, the second coupling members 234, 235 each comprise an elongated shaft which projects substantially acutely with respect to the lower surface 231*a* of the grate cover body 231. It will become apparent that the second coupling members 234, 235 may alternatively project substantially perpendicularly with respect to the lower surface 231*a* of the cover body 231. The second coupling members 234, 235 each are provided with a projection 234*a*, 235*a* which outwardly extends substantially perpendicularly from their respective shafts 234, 235 towards the sidewalls 222, 223. Preferably, the second coupling members 234, 235 extend longitudinally throughout the length of the grate cover 230. The projections 234*a*, 235*a* are spaced from the lower surface 231*a* of the grate cover 230, this space defining a groove or gap 237, 238 in which the first coupling members 226, 227 are pivotably received, respectively, when the grate cover 230 is in the closed position. In this way, the connection between the first coupling members 226, 227 and the second coupling members 234, 235 function together as hinge-type joints.

Accordingly, the second coupling members 234, 235 are adapted to pivot about the respective distal ends of the first coupling members 226, 227 during installation and/or removal of the grate cover 230 from the base conduit 220. In this way, the pivotal engagement between the first coupling members 226, 227 and the second coupling members 234, 235 facilitates the easy installation and removal of the grate cover 230. It will become apparent that any one or both of the respective coupling mechanisms can be adapted to also align the grate cover 230 with respect to the base conduit 220 when placing the grate cover 230 in the closed position.

The system 210 also includes a set of locking mechanisms for locking the grate cover 230 at both sides thereof to the base conduit 220. The locking mechanisms comprise a plurality of fasteners 236, 237 which may include screws, bolts or the like which are rotateably secured into pred-drilled or pre-threaded bores 226*a*, 227*a*, 236*a*, 237*a* that extend throughout the flange members 226, 227 and the grate cover 230. Hence, the locking coupling mechanisms are advantageous in preventing significant longitudinal or vertical displacement of the grate cover 230 with respect to the base conduit 220 once in the closed position. The combination of the coupling and locking mechanisms function to prevent the unintentional, unauthorized or accidental vertical removal of the grate cover 230 with respect to the base conduit 220 once the grate cover 230 is in the closed position.

The grate cover 230 may be connected to the base conduit 220 in a similar manner performed in the previous embodiments. In other words, the grate cover 230 may be manipulated downwardly to a position above the base conduit 220 so as that the distal end of the first coupling member 226 is received into the groove 237 created by the grate cover 230 and the projection 234*a*. Next, the grate cover 230 is again manipulated downwardly so that that the distal end of the first coupling member 227 is received into the groove 238 created by the grate cover 230 and the projection 235*a*, thereby causing the grate cover 230 to be manipulated to the closed position.

When the grate cover 230 is manipulated to the closed position, the second coupling member 235 applies a support force to the distal end of the first coupling member 227. When the system 210 is placed in a trench of the natural surface or pavement area 211, the support force has a magnitude which is at least substantially equal to the force applied to the sidewall 222 by the pavement area 211, and thus, establishes an additional point of connection between the grate cover 230 and the base conduit 220. In order to interconnect a plurality of modular trench drain assemblies 210, the connector member 240 is merely slid under the second coupling members 226, 227.

The locking mechanisms are then deployed by manually or mechanically screwing the fasteners 236, 237 into the pre-drilled or pre-threaded bores of the first coupling members 226, 227 and the grate cover 230. Thus, the combination of the locking and coupling mechanisms function to prevent significant vertical and longitudinal displacement of the grate cover 230 with respect to the base conduit 220 once the grate cover 230 is in the closed position. In addition, the locking and coupling mechanisms facilitate the easy removal of the grate cover 230 in order to perform routine maintenance on the system 210. Of course, because the first and second coupling members are symmetrical, the grate cover 230 may also be manipulated to the closed position by rotating the grate cover 230 180° so that the distal end of the first coupling member 227 enters the gap 237 to form a pivotal engagement with the second coupling member 234.

In a situation in which the natural surface or pavement area 211 expands and/or contracts to thereby distort or deform the base conduit 220, i.e., the sidewalls 222, 223, the grate cover 230 may still be manipulated to the closed position even in the event of an intentional, unintentional, unauthorized or accidental removal from the base conduit 220. In such a scenario, the grate cover body 231 may be manipulated to a position above the base conduit 220 so as to pivotably engage the first coupling member 226 and the second coupling member 234. Next, the side of the grate cover 230, in which the second coupling member 235 extends, is manipulated so that a contact surface at the coupling member 235 applies the support force to the distal end of the first coupling member 227. The support force includes a substantial lateral force component, i.e., as indicated by arrow F in FIG. 6, that causes the upper portion of the sidewall 222 to deflect laterally outwardly. The lateral outward deflection of the sidewall 222 increases the overall area of the chamber 224 to allow the grate cover 230 to rest on the base conduit 220, thereby establishing a detachable pivotal connection between the grate cover 230 and the base conduit 220.

Figure 8:
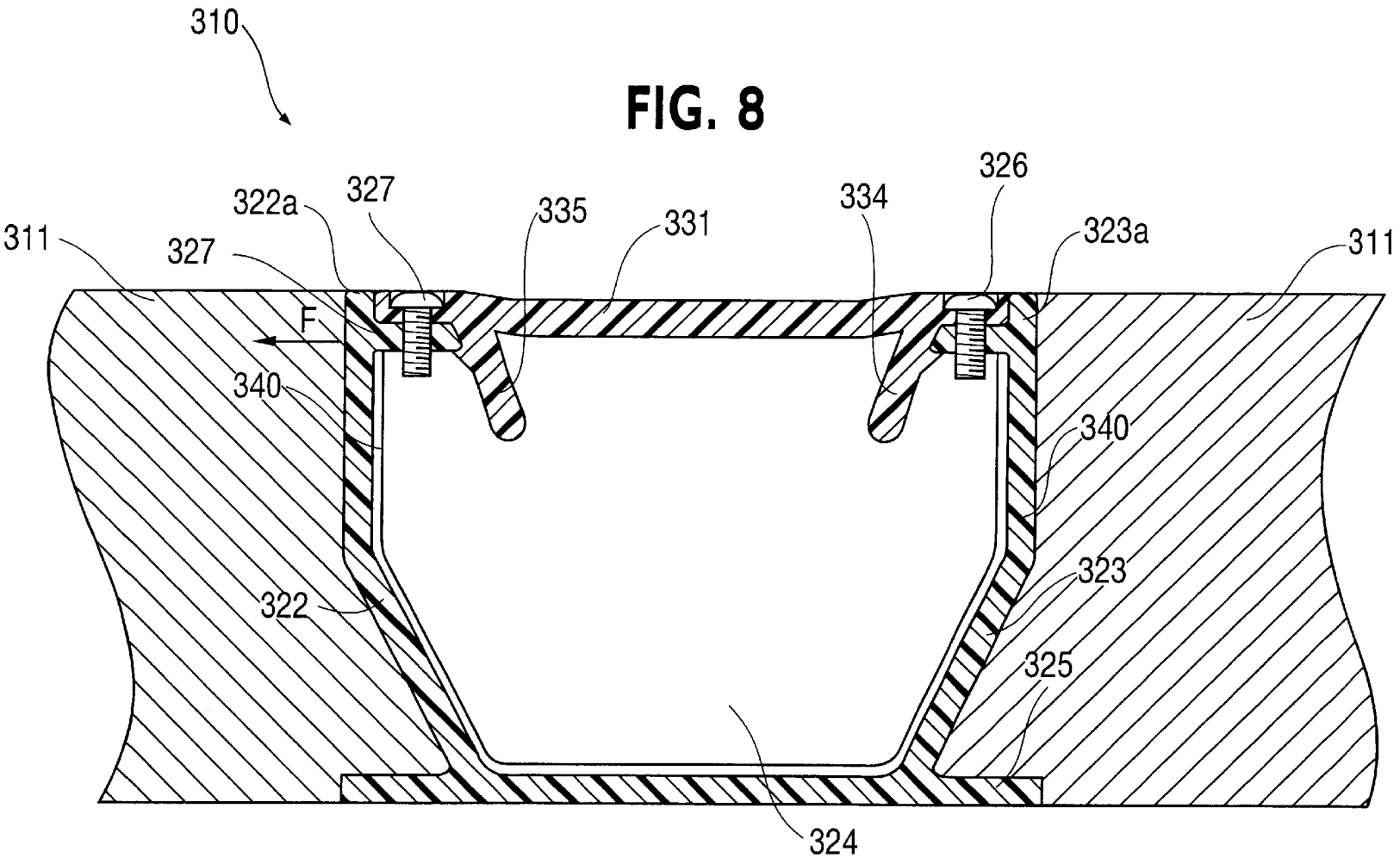
FIG. 8 is a cross-sectional frontal view of the modular trench drain system in accordance with a fourth embodiment of the present invention.
Figure 9:
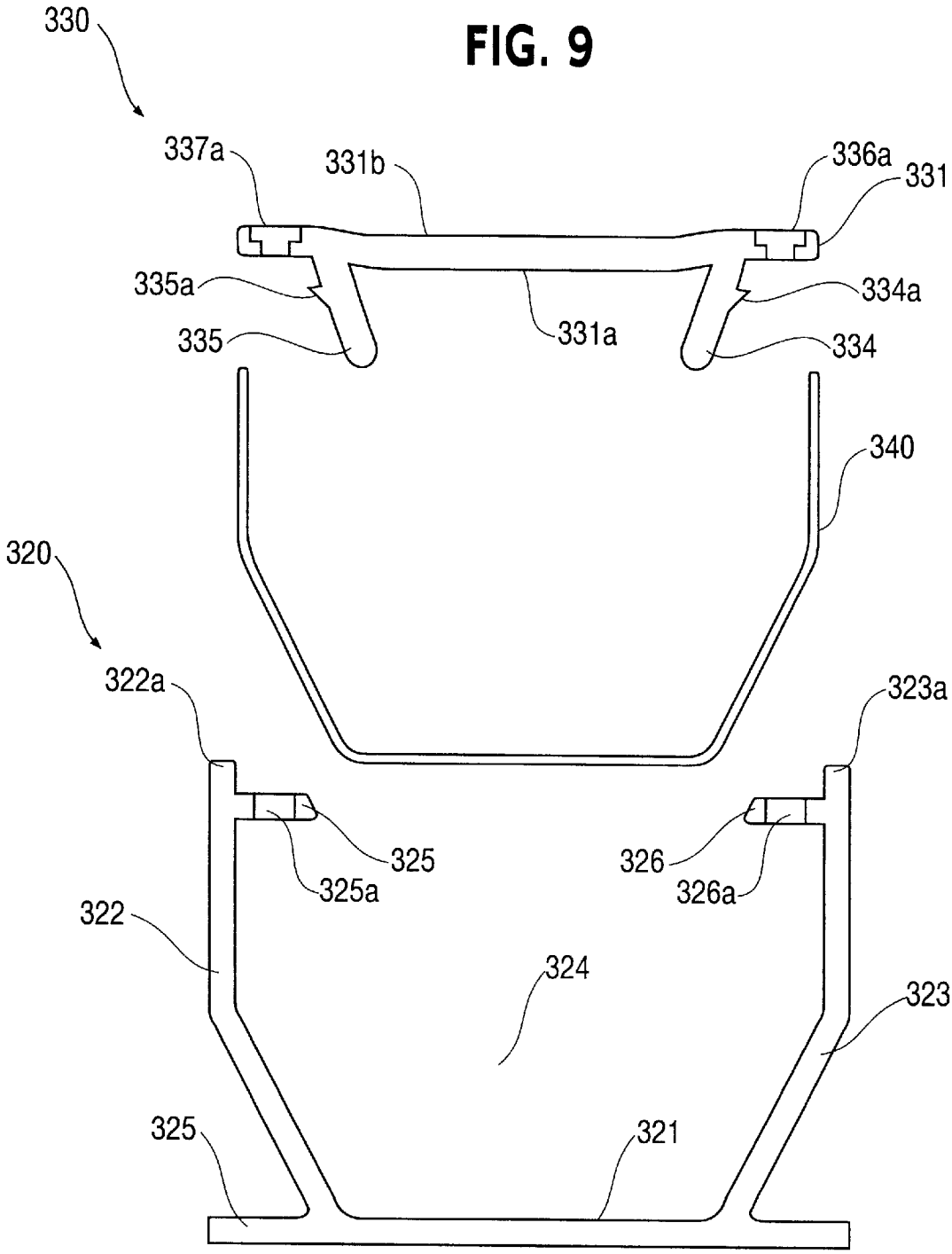
FIG. 9 is a cross-sectional exploded view of the modular trench drain system of FIG. 8.

FIGS. 8 and 9 illustrate a fourth embodiment in accordance with the present invention which parallels the structural and operational features previously described in the third embodiment, but provides additional protection against expansion and/or contraction of a surrounding natural surface or pavement area 311 that may adversely effect the connection between the grate cover 330 and the base conduit 320. In particular, the modular trench drain system 310 of this embodiment includes a substantially hexagonal-shaped base conduit 320, a connector member 340 and a grate cover 330 pivotably connected at both sides thereof to the base conduit 320 so as to cover an exposed open surface of the base conduit 320. The base conduit 320 includes an interior lower wall 321 and pair of opposing sidewalls 322, 323 which extend from the lower wall 321 to define a channel 324 that permits the collection and flow of a liquid such as water and the like. The sidewalls 322, 323 of the fourth embodiment, however, include extensions 322*a*, 323*a* having a distal surface that lies coplanar with an upper surface 331*b* of the grate cover body 331, and thus, is also coplanar with the contiguous surface of the pavement area 311. In this way, the extensions 322*a*, 323*a* protect the grate cover 320 from the effects of expansion and /or contraction of a surrounding natural surface or pavement area 311.

Figure 10:
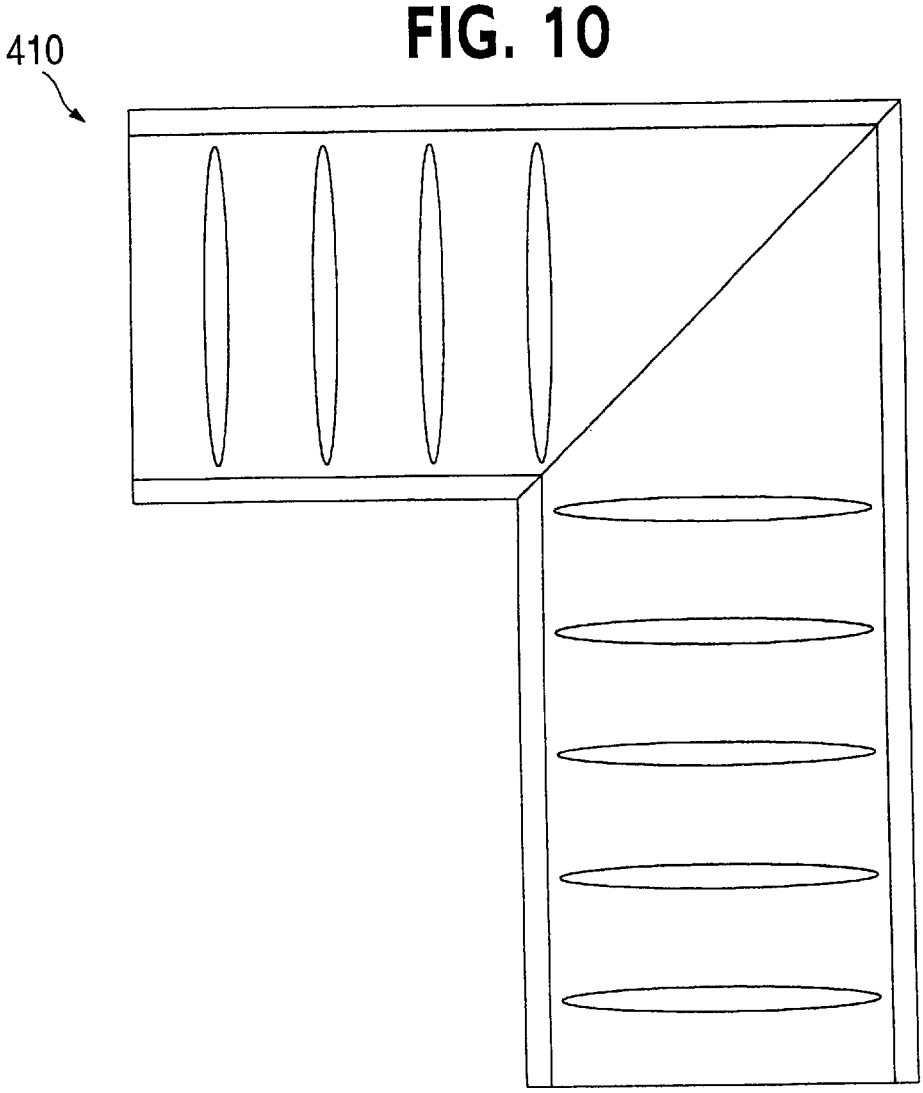
FIG. 10 is a plan view of a 90° modular trench drain adaptor.
Figure 11:
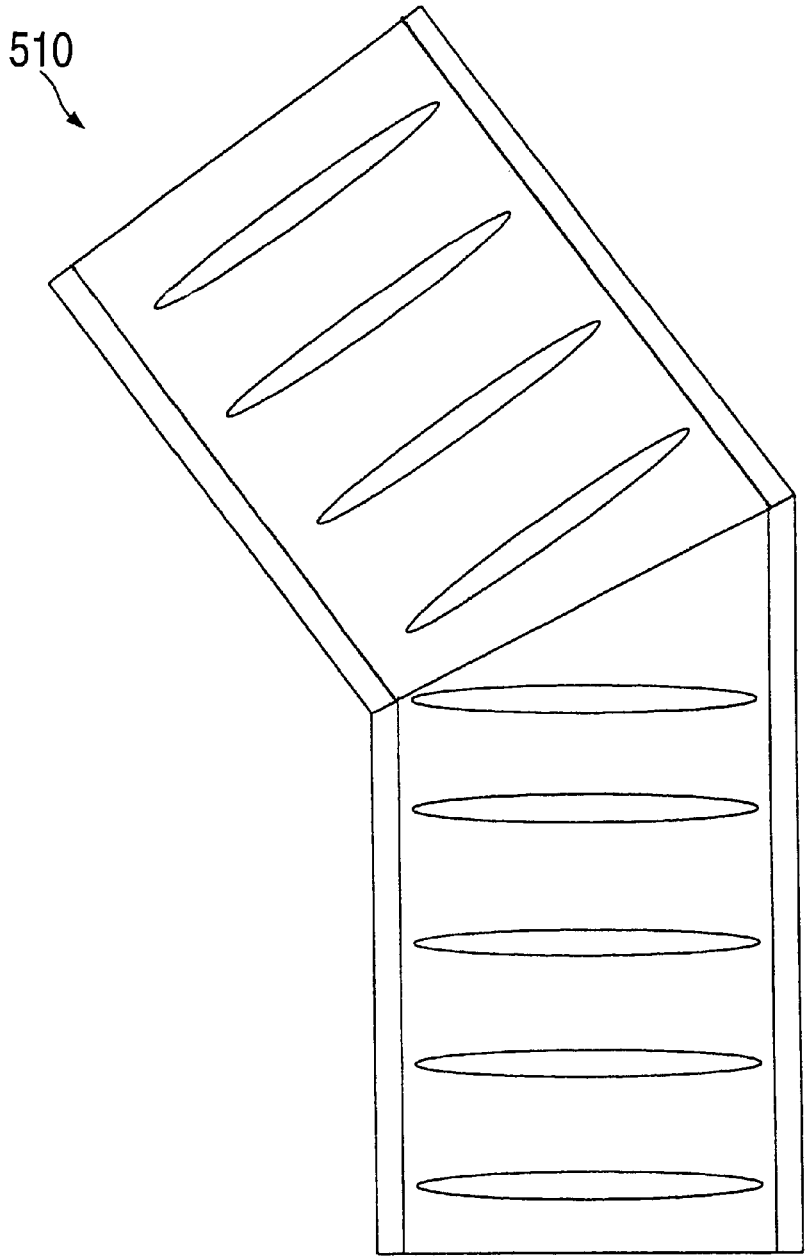
FIG. 11 is a plan view of a 45° modular trench drain adaptor.
Figure 12:
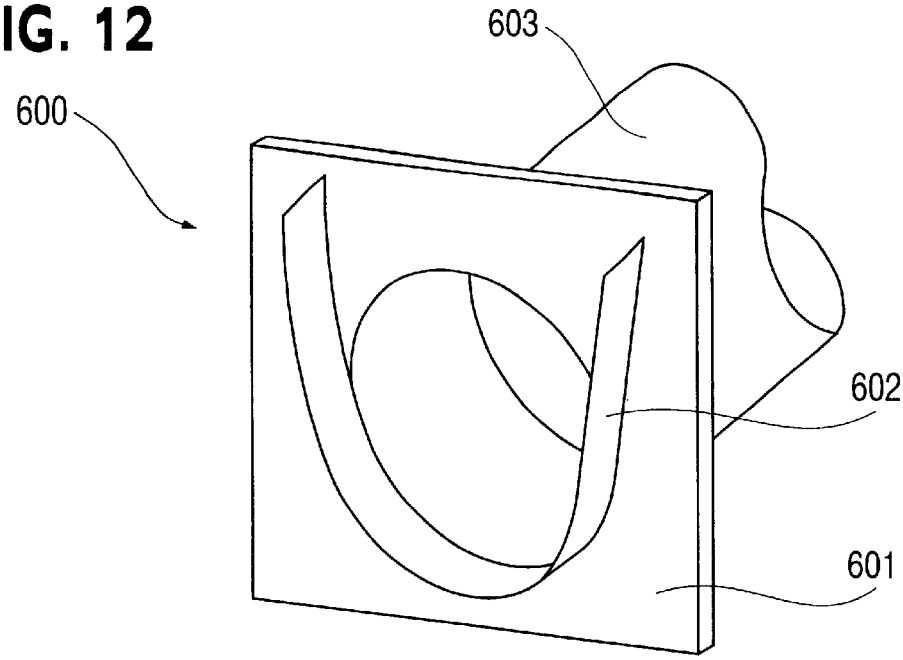
FIG. 12 is a perspective view of an end discharge adapter for use with the modular trench drain system.

Each embodiment of the modular trench drain system may be prefabricated to facilitate a broad range of system configurations. As shown in FIGS. 10 and 11, when changing the direction of the system is required, the end of a drain section may be attached to either 90° drain adaptor 410 or a 45° drain adaptor 510. In a situation that requires the removal of fluid from the system so that it flows axially therethrough, an end discharge adaptor 600, of the kind illustrated in FIG. 12, is inserted into the chamber of a base conduit. The end discharge adaptor 600 comprises a base portion 601 that extends across the open end of a base conduit and a connector portion 602 having a size adapted for receipt into the chamber portion of the base conduit, and a fitting, pipe or tubular section 603 adapted to permit the discharge of the fluid out of the base conduit, and thus, the system. The connector portion 602 is preferably secured to the base conduit using any suitable industrial adhesive or mechanical bonding technique.

Figure 13:
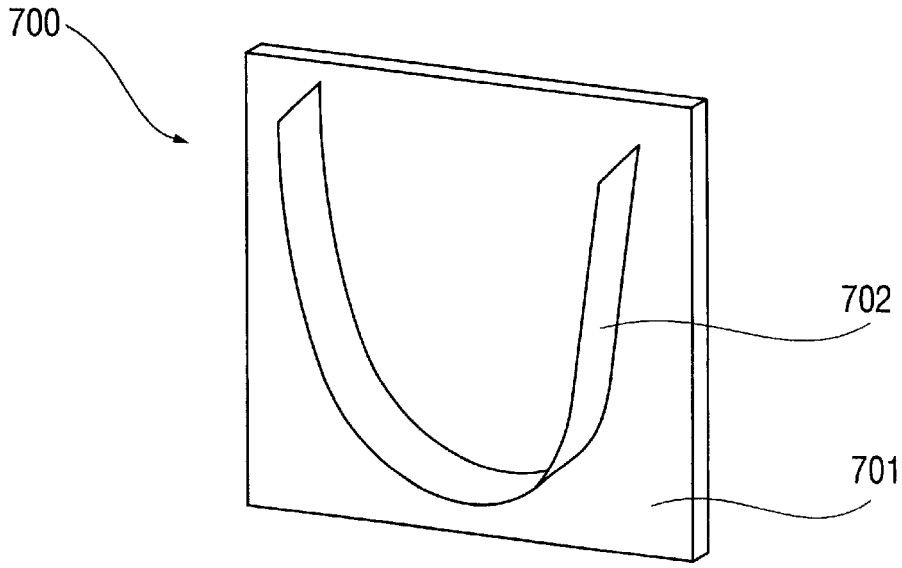
FIG. 13 is a perspective view of an end cap adapter for use with the modular trench drain system.
Figure 14:
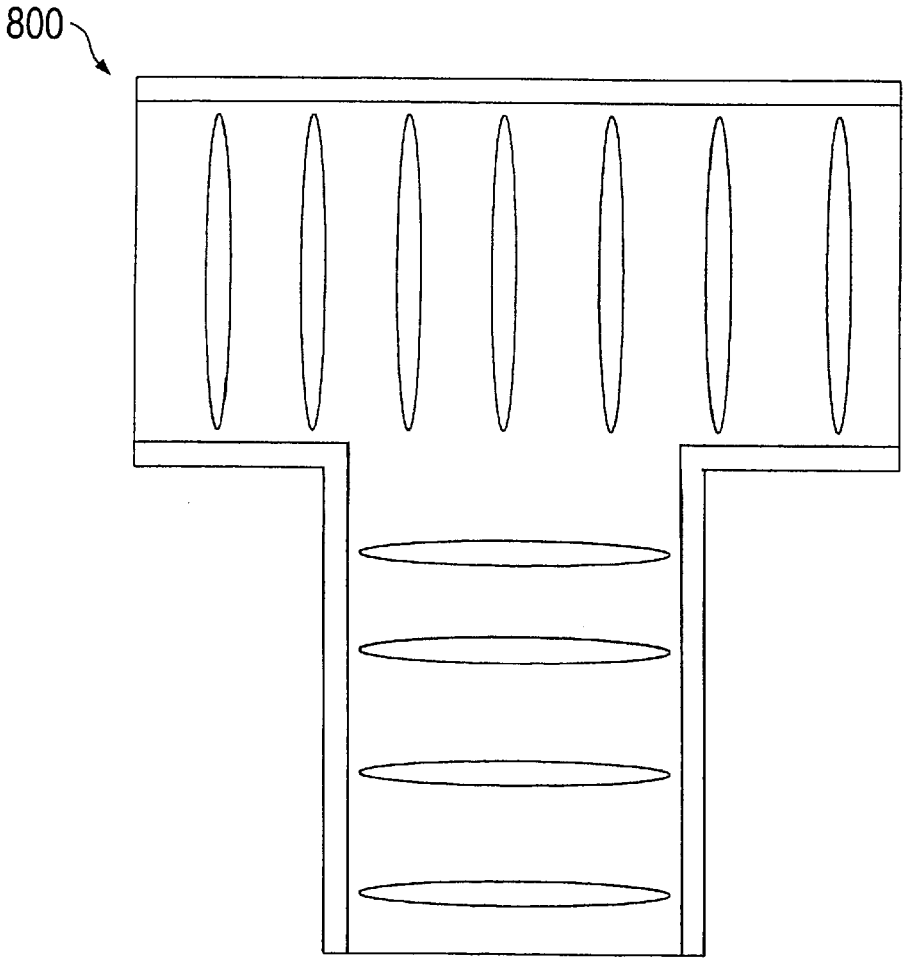
FIG. 14 is a top view of a universal Tee adapter for use with the modular trench drain system.
Figure 15:
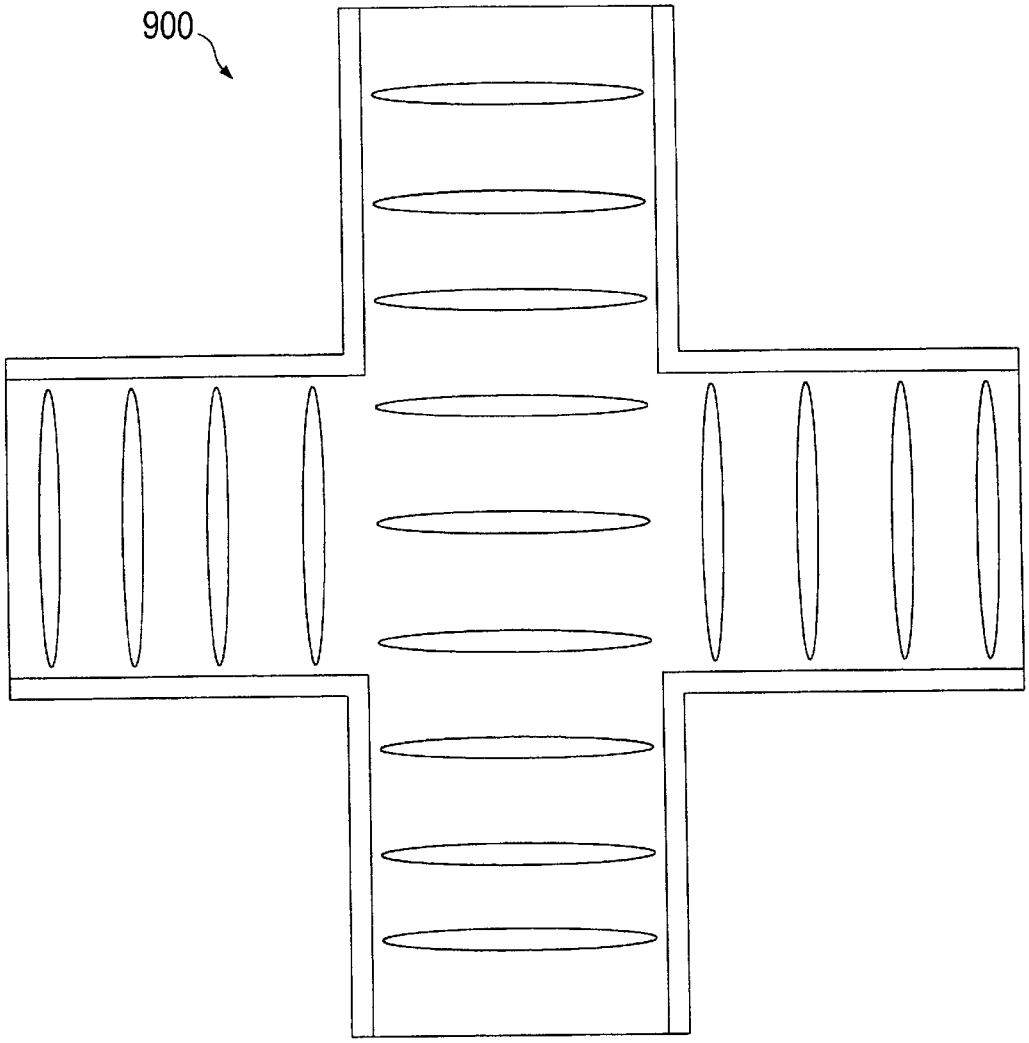
FIG. 15 is a top view of a universal cross adapter for use with the modular trench drain system.

Likewise, an end section of a drain section may be closed by inserting an end plug or cap adapter 700, as shown in FIG. 13, at the chamber of a base conduit. The end plug adapter 700 serves to prevent fluid flow through the base conduit in which it is inserted. The plug adapter 700 comprises a base portion 701 that extends across the open end of the base conduit and a projection member 702 having a size adapted for receipt into the chamber portion of the base conduit. The end plug 700 may be bonded or connected to the interior surface of the base conduit using any suitable industrial adhesive or mechanical bonding technique. Where a universal Tee or cross connection is required, at least one of the systems 800 and 900 illustrated in FIGS. 14 and 15, respectively, may be provided.

Figure 16:
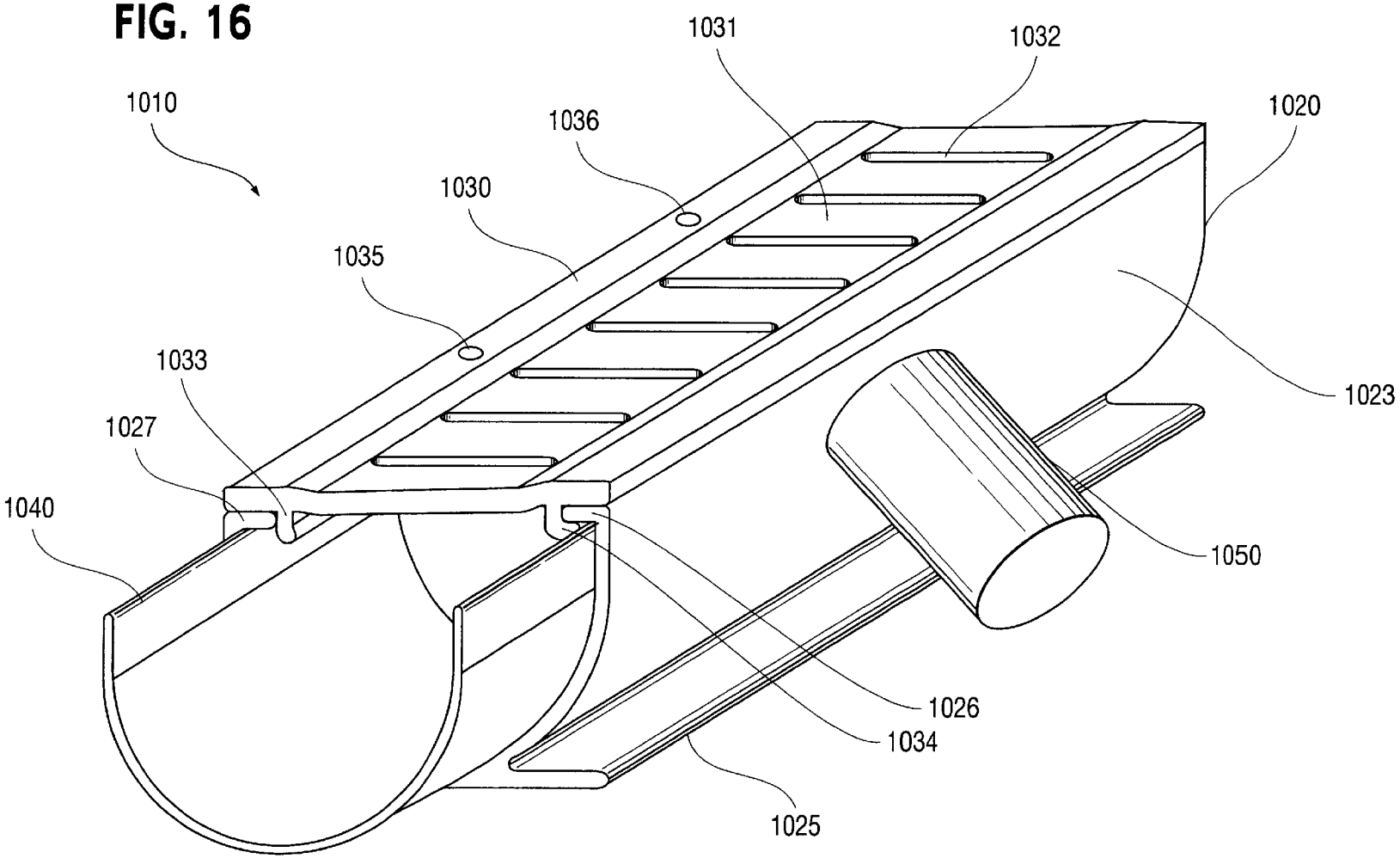
FIG. 16 is a perspective view of a side drainout for use with the modular trench drain system.
Figure 17:
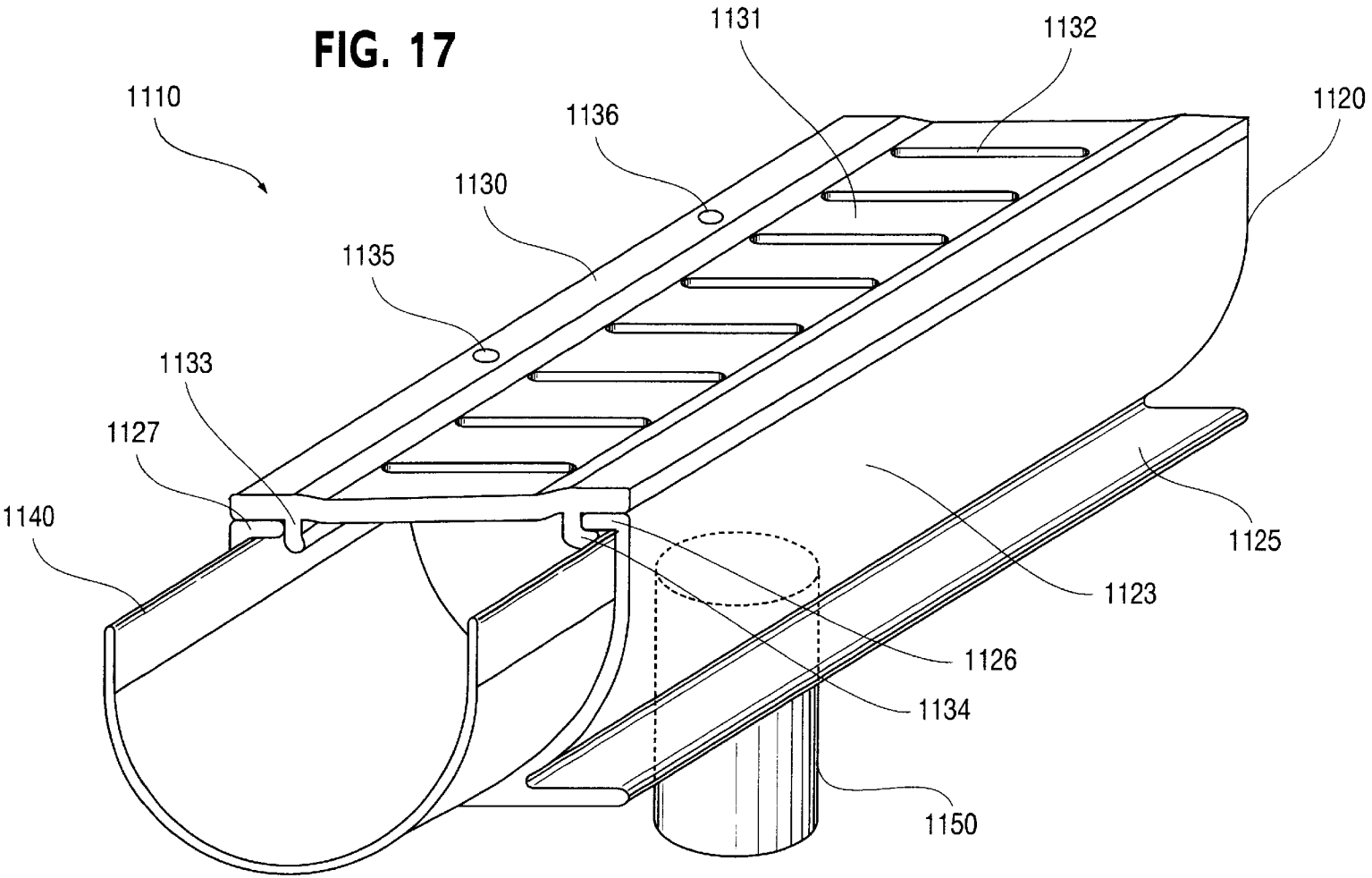
FIG. 17 is a perspective view of a bottom drainout for use with the modular trench drain system.

Water collected into the interior of the system may be suitably flowed away from the site in which the system is employed by interconnecting any conventional piping, fitting or tubing to the drain system. In this regard, each embodiment of the invention may adapted so that any one of the piping, fitting or tubing is connected to extend underneath and/or transversely from the system. As shown in FIG. 16, each embodiment of the invention is adaptable so as to include at least one side drainout adapter 1010 to establish a transverse fluid discharge path from the system. The side drainout 1010 may include the components of each of the previously described embodiments, but is provided with a discharge conduit 1050 comprising a fitting, pipe or tubular section that establishes a transverse fluid discharge path through a sidewall 1023 of a base conduit 1020. FIG. 17 shows an embodiment of the invention in which a bottom drainout adapter 1110 including a discharge conduit 1150 comprising a fitting, pipe or tubular section that establishes a fluid discharge path through a support surface 1125 of the base conduit 1120.

Accordingly, the modular trench drain system of the present invention provides numerous structural and operational advantageous over conventional systems. For example, the coupling mechanism establishes pivotal engagement between the base conduit and the grate cover that allows the facilitation of routine maintenance. The pivotal connection between the base conduit and the grate cover also facilitates the removal of the grate cover from the base conduit in a simple, yet expedient manner. The combination of the coupling mechanism, the alignment mechanism and at least one locking mechanism allows the system to withstand distortion of the base conduit without losing the connection between the grate cover and the base conduit, even in cases in which the base conduit becomes distorted due to the expansion and/or contraction of the surrounding natural surface or pavement area.

The alignment mechanism is advantageous in facilitating reconnection of the grate cover to the base conduit while also permitting realignment between the grate cover and the base conduit even in cases in which the base conduit becomes distorted due to the expansion and/or contraction of the surrounding natural surface or pavement area. The locking mechanism is advantageous in allowing the grate cover to be mechanically fastened to the base conduit to thereby prevent unintentional, accidental or unauthorized open drain conditions.

In accordance with the present invention, it is preferred that each component of the system is composed of a rigid (i.e., durable) material that is capable of withstanding forces exerted by the natural or pavement. It is also preferred that each component of the system is composed of a non-corrosive material that is chemical resistant to most acids, thereby making the system suitable for corrosive environments like oil refineries, coastal areas, marine applications, etc. Moreover, it is preferred that each component of the system is composed of a non-porous material that is resistant to biological growths or attacks. It is also preferred that each component of the system is composed of a nonconductive material, i.e., a material which exhibits high di-electric properties. It is also preferred that each component of the system is composed of a non-porous material (i.e., liquid impermeable). Accordingly, the preferred material in accordance with the invention may comprise a polymer or resin, iron castings, steel, aluminum and composites or like materials that exhibit the aforementioned properties. It is also preferred that whenever interconnecting two or more modular trench drain systems, connectors and/or adapters, a gasket or equivalent device is used in order form a mechanical seal.

The present invention has application in both domestic and commercial environments. For example, the invention has application in an environment characterized by light duty traffic, i.e., an environment that involves pedestrian and cyclist travel. Moreover, the invention also has application in an environment characterized by heavy duty traffic, i.e., an environment that involves slow moving, low traffic for light and heavy vehicles. Lastly, the invention has application in an environment characterized by heavy duty traffic, i.e., an environment that involves high concentration of loads such as the type of loads exhibited on aircraft runways.

Various modifications and alterations to the present invention may be appreciated based on a review of this disclosure. These changes and additions are intended to be within the scope and spirit of this invention as defined by the following claims. In this regard, while the coupling mechanism is designed as a pivotal hinge connection, any known mechanical joint connection may be used without departing from the scope of the invention. Also, any one of the exemplary features of the above-described embodiments may be combined to create a trench drain system.

What is claimed is:

1. A drain system for placement into at least one of a natural surface and a pavement area and subjected to an inward pressure associated with at least one of expansion and contraction of the natural surface or pavement area, the drain system comprising:

a base conduit including a lower wall and first and second opposing sidewalls extending from said lower wall to define a longitudinally-extending channel;

a cover member moveable between an open position exposing said channel and a closed position covering said channel;

a coupling mechanism for securing said cover member to said base conduit when said cover member is in said closed position; and an alignment mechanism for aligning said cover member with respect to said base conduit when said cover member is in said closed position, wherein said alignment mechanism is adapted to apply a support force to at least one of said sidewalls of said base conduit when said cover member is manipulated into said closed position, said alignment mechanism including an alignment bar projecting from a lower surface of said cover member and an alignment flange member projecting substantially perpendicularly from said first sidewall inwardly into said channel.

2. The system according to claim 1, wherein said alignment bar includes a contact surface adapted to apply said support force to a distal end of said alignment flange member when said cover member is in said closed position.

3. The system according to claim 2, wherein said alignment flange member extends longitudinally throughout the length of said base conduit and said alignment bar extends longitudinally throughout the length of said cover member.

4. The system according to claim 1, further comprising a locking device for providing a locking connection between said cover member and said base conduit when said cover member is in said closed position.

5. The system according to claim 1, further comprising at least one end plug for preventing fluid flow through said base conduit.

6. The system according to claim 5, wherein said at least one end plug comprises a base portion extending across an open axial end of said base conduit and a projection member having a size adapted for receipt into said chamber of said base conduit.

7. The system according to claim 1, further comprising at least one end discharge adaptor for permitting the discharge of the fluid from said base conduit.

8. The system according to claim 7, wherein said at least one end discharge adapter comprises a base portion extending across an open axial end of said base conduit and a projection member having a size adapted for receipt into said chamber of said base conduit and a pipe section adapted to permit the discharge of the fluid from said base conduit.

9. A drain system for placement into at least one of a natural surface and a pavement area and subjected to an inward pressure associated with at least one of expansion and contraction of the natural surface or pavement area, the drain system comprising:

a base conduit including a lower wall and first and second opposing sidewalls extending from said lower wall to define a longitudinally-extending channel;

a cover member moveable between an open position exposing said channel and a closed position covering said channel;

a coupling mechanism for securing said cover member to said base conduit when said cover member is in said closed position; and an alignment mechanism for aligning said cover member with respect to said base conduit when said cover member is in said closed position, wherein said alignment mechanism is adapted to apply a support force to at least one of said sidewalls of said base conduit when said cover member is manipulated into said closed position, and said coupling mechanism comprises a first coupling member formed on said second sidewall and a second coupling member formed on a lower surface of said cover member for engagement with said first coupling member when said cover member is in said closed position.

10. The system according to claim 9, wherein said second coupling member is adapted for pivotal engagement about said first coupling member when said cover member is in said closed position.

11. The system according to claim 10, wherein said first coupling member comprises a coupling flange member that extends substantially perpendicularly from said second sidewall and into said channel and said coupling member comprises an elongated shaft and a shoulder portion that projects substantially perpendicularly from said shaft and towards said second sidewall.

12. The system according to claim 11, wherein said shoulder portion is spaced from a lower surface of said cover member, said space defining a gap into which a distal end of said coupling flange member is pivotably received when said cover member is in said closed position.

13. A drain system for placement into at least one of a natural surface and a pavement area and subjected to an inward pressure associated with at least one of expansion and contraction of the natural surface or pavement area, the drain system comprising:

a base conduit including a lower wall and first and second opposing sidewalls extending from said lower wall to define a longitudinally-extending channel;

a cover member moveable between an open position exposing said channel and a closed position covering said channel;

a coupling mechanism for securing said cover member to said base conduit when said cover member is in said closed position; and an alignment mechanism for aligning said cover member with respect to said base conduit when said cover member is in said closed position, wherein said alignment mechanism is adapted to apply a support force to at least one of said sidewalls of said base conduit when said cover member is manipulated into said closed position, and said coupling mechanism comprises upper and lower coupling members formed on said second sidewall and a second coupling member formed on said cover member for engagement with said upper and lower coupling members when said cover member is in said closed position.

14. The system according to claim 13, wherein said second coupling member is adapted for pivotal engagement about said upper and lower coupling members when said cover member is in said closed position.

15. The system according to claim 14, wherein said upper and lower coupling members each comprise a coupling flange member that extends substantially perpendicularly from said second sidewall into said channel and said second coupling member comprises an extension arm which is offset downwardly from an upper surface of said cover member.

16. The system according to claim 15, wherein said upper coupling member is spaced from said lower coupling member, said space defining a gap into which said extension arm is pivotably received when said cover member is in said closed position.

17. A drain system for placement in at least one of a natural surface and pavement area and subjected to an inward pressure associated with at least one of expansion and contraction of the natural surface or pavement area, the drain system comprising:

a base conduit including a lower wall and first and second opposing sidewalls extending from said lower wall to define a longitudinally-extending channel;

a cover member connectable to said base conduit and operable between an open position exposing said channel and a closed position covering said channel, said cover member comprising a body including a lower surface that faces into said channel and an upper surface that is coplanar with the contiguous surface of the natural surface or pavement area when said cover member is in said closed position covering said channel;

a coupling device for securing said cover member to said base conduit when said cover member is in said closed position; and a locking device for providing a locking connection between said cover member and said base conduit when said cover member is in said closed position; and an alignment mechanism for aligning said cover member with respect to said base conduit, said alignment mechanism including a second coupling device comprising an alignment bar that projects from said lower surface of said cover member and an alignment flange member, said alignment flange member projecting substantially perpendicularly from said first sidewall inwardly into said channel;

wherein said alignment bar includes a contact surface adapted to apply a support force to a distal end of said alignment flange member.

18. The system according to claim 17, wherein said alignment flange member extends longitudinally throughout the length of said base conduit and said alignment bar extends longitudinally throughout the length of said cover member.

19. The system according to claim 17, wherein said locking device comprises at least one of a plurality of bolts and a plurality of screws.

20. The system according to claim 17, further comprising at least one end plug for preventing fluid flow through said base conduit.

21. The system according to claim 20, wherein said at least one end plug comprises a base portion extending across an open axial end of said base conduit and a projection member having a size adapted for receipt into said channel of said base conduit.

22. The system according to claim 17, further comprising at least one end discharge adaptor for permitting the discharge of the fluid from said base conduit.

23. The system according to claim 22, wherein said at least one end discharge adapter comprises a base portion extending across an open axial end of said base conduit and a projection member having a size adapted for receipt into said channel of said base conduit and a pipe section adapted to permit the discharge of the fluid from said base conduit.

24. A drain system for placement in at least one of a natural surface and pavement area and subjected to an inward pressure associated with at least one of expansion and contraction of the natural surface or pavement area, the drain system comprising:

a base conduit including a lower wall and first and second opposing sidewalls extending from said lower wall to define a longitudinally-extending channel;

a cover member connectable to said base conduit and operable between an open position exposing said channel and a closed position covering said channel, said cover member comprising a body including a lower surface that faces into said channel and an upper surface that is coplanar with the contiguous surface of the natural surface or pavement area;

a coupling device for securing said cover member to said base conduit when said cover member is in said closed position; and a locking device for providing a locking connection between said cover member and said base conduit when said cover member is in said closed position; and an alignment mechanism for aligning said cover member with respect to said base conduit, said alignment mechanism including a second coupling device comprising an alignment bar that projects from said lower surface of said cover member and an alignment flange member, wherein said alignment bar includes a contact surface adapted to apply a force to a distal end of said alignment flange member, and said coupling mechanism comprises a first coupling member formed on said second sidewall and a second coupling member formed on said lower surface of said cover member for engagement with said first coupling member when said cover member is in said closed position.

25. The system according to claim 24, wherein said second coupling member is adapted for pivotal engagement about said first coupling member when said cover member is in said closed position.

26. The system according to claim 25, wherein said first coupling member comprises a coupling flange member that extends from said second sidewall into said channel and said second coupling member comprises an elongated shaft and a shoulder portion that projects from said shaft and towards side first sidewall.

27. The system according to claim 26, wherein said shoulder portion is spaced from said lower surface of said cover member, said space defining a gap into which a distal end of said coupling flange member is pivotably received when said cover member is in said closed position.

28. A drain system for placement in at least one of a natural surface and pavement area and subjected to an inward pressure associated with at least one of expansion and contraction of the natural surface or pavement area, the drain system comprising:

a base conduit including a lower wall and first and second opposing sidewalls extending from said lower wall to define a longitudinally-extending channel;

a cover member connectable to said base conduit and operable between an open position exposing said channel and a closed position covering said channel, said cover member comprising a body including a lower surface that faces into said channel and an upper surface that is coplanar with the contiguous surface of the natural surface or pavement area;

a coupling device for securing said cover member to said base conduit when said cover member is in said closed position; and a locking device for providing a locking connection between said cover member and said base conduit when said cover member is in said closed position; and an alignment mechanism for aligning said cover member with respect to said base conduit, said alignment mechanism including a second coupling device comprising an alignment bar that projects from said lower surface of said cover member and an alignment flange member, wherein said alignment bar includes a contact surface adapted to apply a support force to a distal end of said alignment flange member, and said coupling mechanism comprises upper and lower coupling members formed on said second sidewall and a second coupling member formed on said cover member for engagement with said upper and lower coupling members when said cover member is in said closed position.

29. The system according to claim 28, wherein said second coupling member is adapted for pivotal engagement about said upper and lower coupling members when said cover member is in said closed position.

30. The system according to claim 29, wherein said upper and lower coupling members each comprise a coupling flange member that extends substantially perpendicularly from said second sidewall into said channel and said second coupling member comprises an extension arm which is offset downwardly from said upper surface of said cover member.

31. The system according to claim 30, wherein said upper coupling member is spaced from said lower coupling member, said space defining a gap into which said extension arm is pivotably received when said cover member is in said closed position.

* * * * *